US010406396B2

(12) United States Patent
Hauptmann

(10) Patent No.: US 10,406,396 B2
(45) Date of Patent: Sep. 10, 2019

(54) DOUBLE ENDED EXERCISE DEVICE

(71) Applicant: U-DO Therapeutics, Inc., Denver, CO (US)

(72) Inventor: Martina E. Hauptmann, Denver, CO (US)

(73) Assignee: U-DO THERAPEUTICS, INC., Denver, CO (US)

( * ) Notice: Subject to any disclaimer, the term of this patent is extended or adjusted under 35 U.S.C. 154(b) by 0 days.

(21) Appl. No.: 15/041,759

(22) Filed: Feb. 11, 2016

(65) Prior Publication Data

US 2016/0236026 A1 Aug. 18, 2016

Related U.S. Application Data

(60) Provisional application No. 62/116,225, filed on Feb. 13, 2015.

(51) Int. Cl.
*A63B 21/04* (2006.01)
*A63B 21/055* (2006.01)
(Continued)

(52) U.S. Cl.
CPC .... *A63B 21/0442* (2013.01); *A63B 21/00043* (2013.01); *A63B 21/00069* (2013.01); *A63B 21/0552* (2013.01); *A63B 21/4035* (2015.10); *A63B 23/03508* (2013.01); *A63B 23/03541* (2013.01); *A63B 23/03575* (2013.01); *A63B 21/0555* (2013.01); *A63B 21/1645* (2013.01); *A63B 21/1654* (2013.01); *A63B 21/1663* (2013.01); *A63B 21/4034* (2015.10); *A63B 23/0216* (2013.01); *A63B 23/0233* (2013.01); *A63B 23/0405* (2013.01);
(Continued)

(58) Field of Classification Search
CPC ..... A63B 21/0442; A63B 21/0552; A63B 21/00043; A63B 21/0557; A63B 21/4035; A63B 21/4015; A63B 21/4019; A63B 21/4021; A63B 21/16–1663; A63B 21/02; A63B 21/04; A63B 21/055; A63B 2023/006; A63B 21/0555; A63B 21/4034; A63B 23/03541; A63B 23/03508; A63B 23/03575; A63B 23/1245; A63B 23/1272; A63B 23/0216; A63B 23/0233
USPC ..... 482/124–126, 129, 140
See application file for complete search history.

(56) References Cited

U.S. PATENT DOCUMENTS 3,677,543 A * 7/1972 Richardson ..... A63B 21/04 24/129 R
3,858,874 A * 1/1975 Weider ..... A63B 21/154 273/DIG. 6
(Continued)

FOREIGN PATENT DOCUMENTS

CA 2801763 A1 * 7/2014 ..... A63B 21/002

*Primary Examiner* — Jennifer M Deichl
(74) *Attorney, Agent, or Firm* — Perkins Coie LLP

(57) ABSTRACT

A portable full body exercise device is described. The device can be affixed inside a door jamb from either end to perform a variety of exercises and can also be used to exercise free of a door on a chair, bed, or mat. This versatile device is comprised of a handle at one end, an elastic membrane (middle portion), and a double loop/door attachment end. The design of the device allows the resistance of the elastic membrane to be altered from both ends, allowing more or less resistance to be achieved by altering the elastic membrane's overall length.

8 Claims, 26 Drawing Sheets

(51) Int. Cl.

| | |
|---|---|
| ***A63B 23/035*** | (2006.01) |
| ***A63B 21/00*** | (2006.01) |
| ***A63B 71/00*** | (2006.01) |
| ***A63B 21/16*** | (2006.01) |
| ***A63B 23/02*** | (2006.01) |
| ***A63B 23/04*** | (2006.01) |
| ***A63B 23/12*** | (2006.01) |
| ***A63B 23/00*** | (2006.01) |

(52) U.S. Cl.

CPC ..... *A63B 23/047* (2013.01); *A63B 23/0488* (2013.01); *A63B 23/1209* (2013.01); *A63B 23/1245* (2013.01); *A63B 23/1272* (2013.01); *A63B 71/0054* (2013.01); *A63B 2023/006* (2013.01); *A63B 2023/0411* (2013.01); *A63B 2208/0204* (2013.01); *A63B 2208/0209* (2013.01); *A63B 2208/0233* (2013.01); *A63B 2208/0252* (2013.01); *A63B 2208/0257* (2013.01); *A63B 2210/00* (2013.01); *A63B 2210/54* (2013.01)

(56) References Cited

U.S. PATENT DOCUMENTS

| | | | | | |
|---|---|---|---|---|---|
| 3,937,465 | A * | 2/1976 | Roland | A63B 69/38 | 473/229 |
| 4,121,827 | A * | 10/1978 | Weider | A63B 21/0004 | 482/125 |
| 4,733,862 | A * | 3/1988 | Miller | A63B 21/0552 | 24/129 R |
| 5,100,129 | A | 3/1992 | Porter et al. | | |
| 5,186,698 | A | 2/1993 | Mason et al. | | |
| 5,518,486 | A * | 5/1996 | Sheeler | A63B 21/0004 | 482/131 |
| D373,803 | S * | 9/1996 | Winans | D21/684 | |
| 5,558,609 | A | 9/1996 | Olschansky et al. | | |
| 5,595,559 | A | 1/1997 | Viel | | |
| 5,688,213 | A | 11/1997 | Recker | | |
| 5,813,954 | A * | 9/1998 | Wilkinson | A63B 21/0004 | 482/124 |
| 6,036,626 | A | 3/2000 | Taylor | | |
| 6,368,258 | B1 | 4/2002 | Emlaw | | |
| 6,386,588 | B1 * | 5/2002 | Young | A44B 11/12 | 280/821 |
| 6,921,354 | B1 * | 7/2005 | Shifferaw | A63B 21/068 | 482/126 |
| 7,749,141 | B2 | 7/2010 | Meisterling | | |
| 7,955,236 | B2 | 6/2011 | DiGiovanni et al. | | |
| 8,282,536 | B2 * | 10/2012 | Latronica | A63B 21/16 | 482/121 |
| D674,448 | S * | 1/2013 | Puig | D21/662 | |
| 8,403,818 | B1 * | 3/2013 | Wilkinson | A63B 21/00069 | 482/121 |
| 9,265,985 | B2 * | 2/2016 | Uygan | A63B 21/4035 | |
| 2006/0183609 | A1 | 8/2006 | Flynn | | |
| 2012/0100968 | A1 * | 4/2012 | Tilton | A63B 21/0442 | 482/131 |
| 2013/0165301 | A1 * | 6/2013 | Thrasher-Rudd | A63B 7/00 | 482/129 |
| 2014/0082891 | A1 * | 3/2014 | Hetrick | A44B 11/2557 | 24/115 H |

* cited by examiner

DOUBLE ENDED EXERCISE DEVICE

CROSS-REFERENCE TO RELATED APPLICATION

This application is a non-provisional of and claims priority to U.S. Provisional Application No. 62/116,225, filed on Feb. 13, 2015, entitled "DOUBLE ENDED EXERCISE DEVICE," which is hereby incorporated by reference in its entirety for all purposes.

TECHNICAL FIELD

The disclosure generally relates to an exercise device that allows strengthening of the entire body. More particularly, embodiments of the exercise device allow a user to mimic exercises typically done on large Pilates pieces of equipment and/or to mimic exercises typically done with a cable column at a gym.

BACKGROUND

It is well known that consistent exercise is necessary to maintain health and fitness. However, personal schedules can make it difficult to get to the gym or the Pilates studio to workout. Therefore, lightweight and space saving home exercise equipment solutions are important.

Pilates is a method of exercise that works to increase an individual's strength and flexibility and to improve posture with precise, specific exercises. Pilates can be done on a mat or on special equipment typically found in a Pilates studio such as the reformer or the cadillac. The sizes and weights of the reformer and cadillac make it impossible for many people to purchase them for home use. Moreover, neither the reformer nor the cadillac can be taken when a person travels.

A cable column weight system is a popular, versatile exercise option used at a gym. However, its weight and size make it difficult to purchase for home use and travel with the cable column weight system is impossible.

There are a number of devices in the prior art that also create portable exercise solutions.

U.S. Pat. No. 6,036,626 to Taylor discloses a portable exercise device. However, the design of this device does not allow it to be attached inside of a door jamb, and, therefore, it cannot be used to mimic exercises done with a cable column weight system. Because of this lack of a door attachment, this device is also limited in the number of reformer and cadillac exercises that can be done with it. Furthermore, its foot loop is not adjustable and will have a tendency to fall off of the foot causing interruption and irritation to the user. Moreover, this device does not have a restraining loop to keep the loose end of the resistance member from getting in the way of the user.

U.S. Pat. No. 5,186,698 to Mason et al. discloses a portable exercise formed without rigid components. However, this device lacks a handle, which limits the capability of the number and the comfort of the exercises. Also, the device is specifically geared toward ankle exercises, and the foot loop is unable to be placed around the thigh, limiting the versatility of this device. Also, the device cannot be affixed in a door jamb to allow for arm and core exercises, because its door attachment is found only at the hand loop portion. Therefore, using this device to mimic a cable column weight system, reformer, or cadillac exercises is limited. Additionally, the device is not adjustable, which limits the overall amount of resistance that can be supplied to the user. The user will only be able to move his body farther away from the band to create increased resistance which will significantly limit the exercise options of the individual, especially when using the device not attached to a door.

U.S. Pat. No. 5,688,213 to Recker also discloses a portable exercise device. However, its stirrup design limits the placement of the foot stirrup portion to the foot only. Accordingly, no attachment to the thigh is possible. Also there is no door attachment component, which further limits the number of exercises capable of being performed with the device. That the device is not adjustable also limits the overall resistance the device is able to afford the user. As such, individuals of different heights will have either greater or lesser resistance, and they will not be able to personalize the resistance to their height—the design of this resistance system is one size fits all.

U.S. Pat. No. 5,518,486 to Sheeler discloses another device, device which is flexible and portable in nature. However, the device is inelastic, which significantly limits the type, effectiveness and comfort of the exercises possible with this device. There is no ability for the freedom of movement necessary to mimic reformer or cadillac exercises. Furthermore, users cannot perform cable column weight system exercises with this device.

The present disclosure overcomes these and other limitations of existing exercise devices and provides other benefits as will become clearer to those skilled in the art from the following description.

OVERVIEW

The present disclosure describes a versatile, affordable, portable, and space-saving exercise device that can be used by Pilates instructors, personal trainers, physical therapists, patients and home users to mimic full body exercises typically done on a reformer or cadillac at a Pilates studio and/or mimic exercises typically done with a cable column weight system at a gym. The exercise device may be used as a set to perform symmetrical exercises. However, the exercise device may also be used singularly for rehabilitative exercises in a physical therapy clinic post injury. The exercise device contains a number of components that make the exercise device unique and capable of a variety of exercises.

Embodiments of the exercise device described herein include a handle, a double loop/door attachment, and an elastic resistance member. The elastic resistance member is coupled to the handle at one end and coupled to the double loop/door attachment at the opposing end. Some embodiments of the exercise device allow the resistance of the elastic resistance member to be adjusted from both ends. More or less resistance is achieved by altering the overall length of the resistance member.

The adjustable nature of the exercise device is, in various embodiments, created at the handle end by threading the elastic resistance member through a triglide slide (or other similar attachment component). The triglide slide is attached to a handle via webbing. To decrease slippage of the elastic resistance member while in use, anti-skid material is affixed to the webbing of the handle at the triglide slide. The anti-skid material is affixed to the webbing of the handle. To keep the ends of the resistance member from hanging loose and interfering with the user, an elastic loop is coupled with the side of the handle. The elastic loop may be slid up or down along the length of the webbing from the triglide slide to the rigid part of the handle.

In at least some embodiments, the double loop/door attachment end has two loops of differing sizes for different functions. The larger loop can be used for exercises where the user's shod or unshod foot, ankle or the thigh is inserted inside the loop. A triglide slide may be provided, through which the elastic resistance member may be threaded, making the double loop/door attachment end adjustable. The smaller loop is designed to go around the arch of the user's unshod foot for exercises where otherwise the larger loop would fall off of the foot. This creates ease of transitions between exercises especially when going from standing exercises to supine exercises to prone exercises. In certain embodiments, the smaller loop includes a door attachment feature, which allows a large variety of exercises to be performed with the device affixed in a door jamb.

Anti-skid material may be affixed to the webbing of the double loop/door attachment end to decrease the chances that the elastic resistance member will slip during exercising. This anti-skid material may be sewn, glued, or otherwise affixed to the webbing of the double loop/door attachment end of the exercise device. To keep the end of the elastic resistance member from hanging loose and interfering and/or tripping the user, an elastic loop may be sewn around the side of the double loop/door attachment to restrain the tail of the elastic resistance member. The elastic loop has the capability to be slid up or down along the length of the webbing from the triglide slide to the rigid part of the handle. Since the double loop/door attachment is used for lower extremity exercises and can be used in the standing position, the elastic loop decreases the chance that the user will step on the loose tail, causing him to trip and fall.

In some embodiments, the exercise device has a double loop system (as previously described), but without a door attachment. This may be advantageous for individuals, gyms or studios where there is no ability to attach the exercise device into a door jamb, which streamlines the design for these situations.

The exercise device can also be attached to a pole or a ballet barre by looping the elastic resistance member through the webbing of the handle and around the pole or barre. This application allows leg and core exercises to be performed with the free double loop/door attachment end. Another application is looping the elastic resistance member around the pole or barre and threading the elastic resistance member through the larger loop of the double foot loop/door attachment end, causing the handle to be free for arm and core exercises.

In some embodiments, the elastic resistance member is one inch in width and has varying lengths of from 24 inches to 36 inches. The one inch width of the resistance member makes it possible to mark the resistance member with symbols or numerals in order to make symmetrical adjustment of the resistance easy and effective. Marking bungee cords or elastic tubing is much more difficult because of the small diameter of these elastic members and, if marked, are difficult for the user to see.

The elastic resistance member may vary in the level of resistance. The overall resistance of each resistance member can be adjusted by shortening or lengthening the resistance member at the handle or at the double foot loop/door attachment end. As mentioned previously, the resistance member is threaded through the triglide slide. A plastic rivet may be attached at one or both ends of the resistance member to prevent it from disengaging.

In another embodiment, the handle end is altered to a hand stirrup design. In this embodiment, elastic or inelastic webbing crosses the palm from between the thumb and index finger to the edge of the wrist. At the wrist, an elastic loop encircles the wrist and keeps the hand stirrup from falling off of the user's hand while exercising. This variation may be used for full body exercises where weight bearing through an open palm is necessary. These types of exercises are often done in yoga classes. The double loop/door attachment end is altered to no longer have the door attachment feature.

In yet another embodiment, the double loop/door attachment end is altered to create a foot stirrup design. The foot stirrup design has inelastic webbing that encircles the arch of the foot and elastic webbing attached to the inelastic webbing that encircles the back of the heel/lower calf of the user. This design change may be used for exercises typically done in a yoga class. The other design elements of the exercise device would remain the same. For example, the elastic resistance member would remain adjustable at both ends at the triglide slide. The webbing underneath the triglide slide has anti-skid material permanently affixed to the webbing to decrease slippage of the elastic member while exercising. The elastic loop may be present at both the hand and foot ends to restrain the tail of the elastic member from hanging loose and irritating or tripping the user.

BRIEF DESCRIPTION OF THE DRAWINGS

The exercise device systems introduced here may be better understood by referring to the following Detailed Description in conjunction with the accompanying drawings.

Figure 1A:
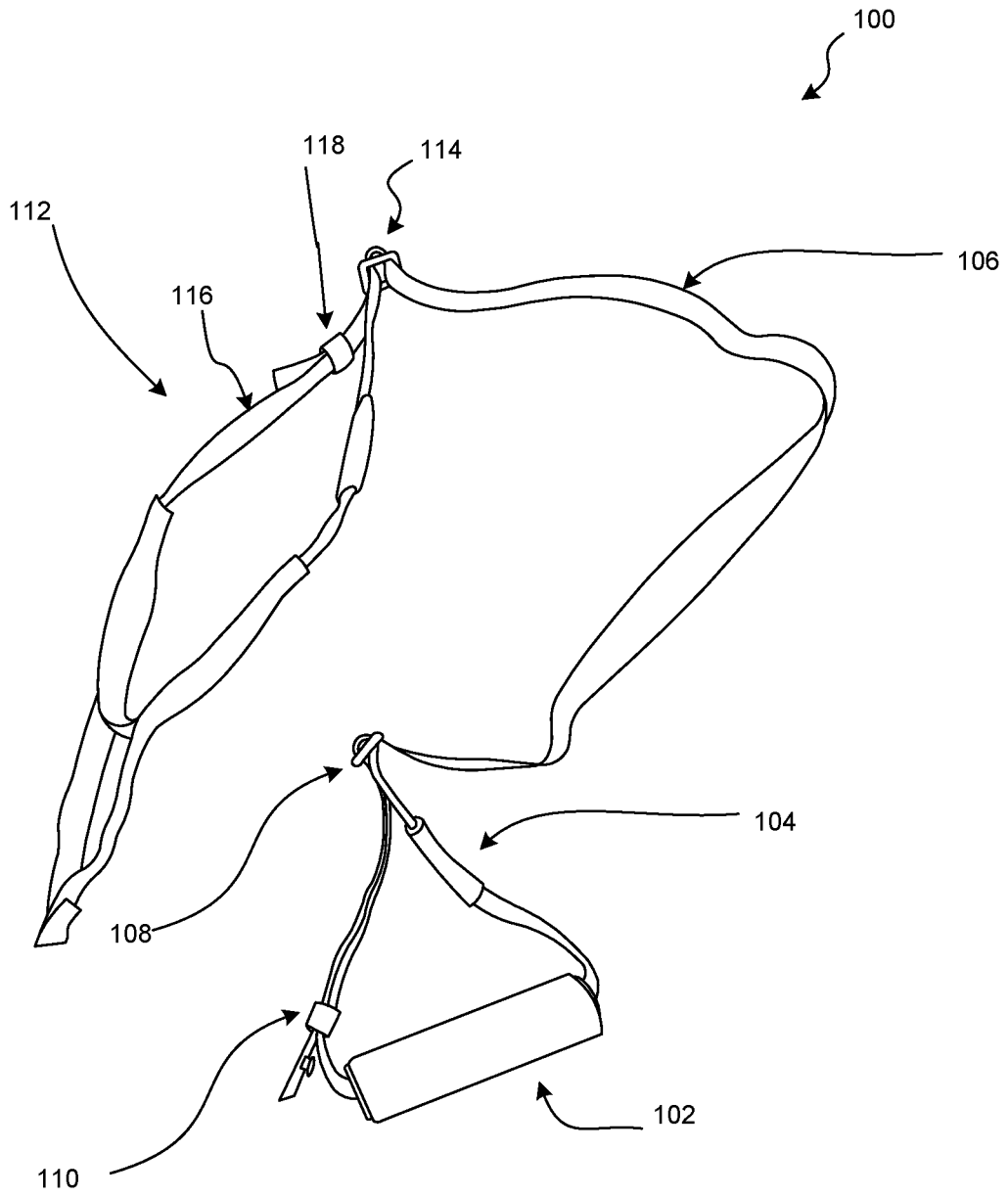
FIG. 1A illustrates one embodiment of an exercise device according to the present technology with a handle and a double loop/door attachment.

The headings provided herein are for convenience only and do not necessarily affect the scope or meaning of the present disclosure. Further, the drawings have not necessarily been drawn to scale. For example, the dimensions of some of the elements in the figures may be expanded or reduced to help improve the understanding of the embodiments of the present disclosure. Moreover, while the disclosed technology is amenable to various modifications and alternative forms, specific embodiments have been shown by way of example in the drawings and are described in detail below. The intention, however, is not to limit the disclosure to the particular embodiments described. On the contrary, the disclosure is intended to cover all modifications, equivalents, and alternatives falling within the scope of the disclosure as defined by the appended claims.

DETAILED DESCRIPTION

The exercise devices described herein are versatile, lightweight, and portable. The complete design of the exercise devices allows exercises to be done at home or on vacation without the cumbersome size or weight of the reformer, cadillac, or cable column weight system.

The exercise devices described enable users to perform Pilates exercises such as those performed on reformer and cadillac systems but in a more portable and affordable manner. In some embodiments, this is accomplished by attaching exercise devices of the present technology as a set attached to a door or free of a door, allowing the user to mimic a large number of Pilates reformer and cadillac exercises without the cost or space requirements of these exercise devices. Additionally, when attached in a door jamb, the exercise device can mimic a cable column weight system, allowing the user to do traditional resistance training at home or on the road. The exercise device can be used singularly or as a set.

This allows the user to get a full body Pilates workout at home or when traveling. The exercise devices described herein are easily packed because they do not have any rigid portions and can be rolled or folded to fit inside of a suitcase.

Embodiments of the exercise device ease the adjustment of the elastic resistance member. The adjustable capability personalizes the workout experience to the exerciser's height and fitness level. This is accomplished by making the exercise device adjustable from both ends via a triglide slide at the handle and the double loop/door attachment end. Furthermore, in a variation of the exercise device, the addition of numerals or symbols on the elastic resistance member makes for easy symmetrical adjustment of the resistance. This is helpful when using the exercise device as a set. Bungee cords and/or elastic tubing can be marked, but it will be difficult for the user to see the markings because of their small diameter.

The exercise device described herein allows for easy replacement of the elastic resistance member should it break. In the unfortunate case that this occurs, the plastic rivet can be cut off and removed from the triglide slide. A new elastic resistance member can then be threaded through the triglide slide. Finally another rivet can be attached to the ends of the new elastic resistance members to complete the repair.

Embodiments of the exercise device described herein can be used in conjunction with the Hooked on Pilates MINI-MAX (U.S. Pat. No. 8,632,443), BOSU or Pilates arc barrel, for example. Being able to use the exercise device with any of the aforementioned devices is useful for individuals with tight hamstrings where long sitting (sitting on the floor with leg outstretched) will cause excessive stretching of the hamstrings, which further causes the user's pelvis to rotate posteriorly and strain the user's low back. The user is able to sit on such aforementioned devices; this will slightly elevate the hips and will decrease the strain on the hamstrings and back. This allows the user to be in the long sitting position, stretching the hamstrings, but without strain. The exercise device can then be attached to the user's feet in order to do a number of core and arm exercises in this modified long sitting position. Another option is to long sit on one of the aforementioned devices and attach the exercise device in a door jamb, allowing the user to do a number of arm and core exercises. These options will allow the user to eventually gain more flexibility with the long sitting position.

Another application with the exercise devices of the present technology is for individuals with lumbar stenosis (narrowing of the spinal canal, common with advancing age). With stenosis, lying prone (face down on the floor) can cause pain, because the lumbar spine may become extended due to lumbar alignment and stiffness. One of the aforementioned devices placed under the abdomen of an individual will allow for a slightly flexed prone position. The exercise device can then be attached to the user's feet or to a door jamb to allow the user to do resistive back, arm, and leg exercises in the prone position, thereby strengthening without going into extension or backward bending, which can cause pain for individuals with lumbar spinal stenosis.

Various examples of the exercise devices introduced above will now be described in further detail. The following description provides specific details for a thorough understanding and enabling description of these examples. One skilled in the relevant art will understand, however, that the techniques discussed herein may be practiced without many of these details. Likewise, one skilled in the relevant art will also understand that the technology can include many other obvious features not described in detail herein. Additionally, some well-known structures or functions may not be shown or described in detail below so as to avoid unnecessarily obscuring the relevant description.

The terminology used below is to be interpreted in its broadest reasonable manner, even though it is being used in conjunction with a detailed description of some specific examples of the exercise device. Indeed, some terms may even be emphasized below; however, any terminology intended to be interpreted in any restricted manner will be overtly and specifically defined as such in this section.

Turning now to the figures, FIG. 1A illustrates an exercise device 100 with a handle 102 located at a first end of the exercise device 100 and a double loop/door attachment located at an opposing end of the exercise device 100. In various embodiments, handle 102 is formed by a flexible, inelastic material such as cotton or polypropylene webbing 104 threaded through a hollow plastic handle which is covered by foam. Handle 102 may include a plastic triglide slide 108 (or other attachment mechanism) to attach to an adjustable elastic resistance member 106. Elastic resistance member 106 may be threaded through plastic triglide slide 108. The attachment mechanism may also act as an adjustment mechanism. That is, more or less of the elastic resistance member can be passed through the plastic triglide slide 108 to increase or decrease resistance of the elastic resistance member 106. Elastic resistance member 106 is resilient. Anti-skid material can be sewn or otherwise permanently affixed onto webbing 104 where the elastic resistance member 106 attaches to handle 102 to decrease slippage of the elastic resistance member 106 when the exercise device 100 is in use.

On the side of the handle that receives elastic resistance member 106 through plastic triglide slide 108, exercise device 100 can include an elastic loop 110 (or other securing member) designed to secure loose ends of elastic resistance member 106. Elastic loop 110 may be moveable. In some embodiments, elastic loop 110 may be stationary.

In some embodiments, elastic resistance member 106 has a length of 24 to 36 inches and a width of one inch. Elastic resistance member 106 may be made of a natural rubber or latex material allowing for resistance to occur as it is stretched. Elastic resistance member 106 comes in varying levels of resistance. A fastener such as a rivet may be affixed at one or both ends of elastic resistance member 106 to ensure that resistance member 106 does not slide out of the triglide slide 108.

Exercise device 100 further includes double loop/door attachment 112. Double loop/door attachment 112 may be formed by a flexible, inelastic material such as polypropylene webbing.

Double loop/door attachment 112 may include a plastic triglide slide 114 (or other attachment mechanism) to attach to elastic resistance member 106. Elastic resistance member 106 may be threaded through plastic triglide slide 114. Anti-skid material can be sewn or otherwise permanently affixed to webbing 116 where the elastic resistance member 106 attaches to double loop/door attachment 112 to decrease slippage of the elastic resistance member 106 when the exercise device 100 is in use. Double loop/door attachment 112 may also include an elastic loop 118 to secure loose ends of elastic resistance member 106. A rivet may be affixed at the end of elastic resistance member 106 to ensure that resistance member 106 does not slide out of the triglide slide 114.

Figure 1B:
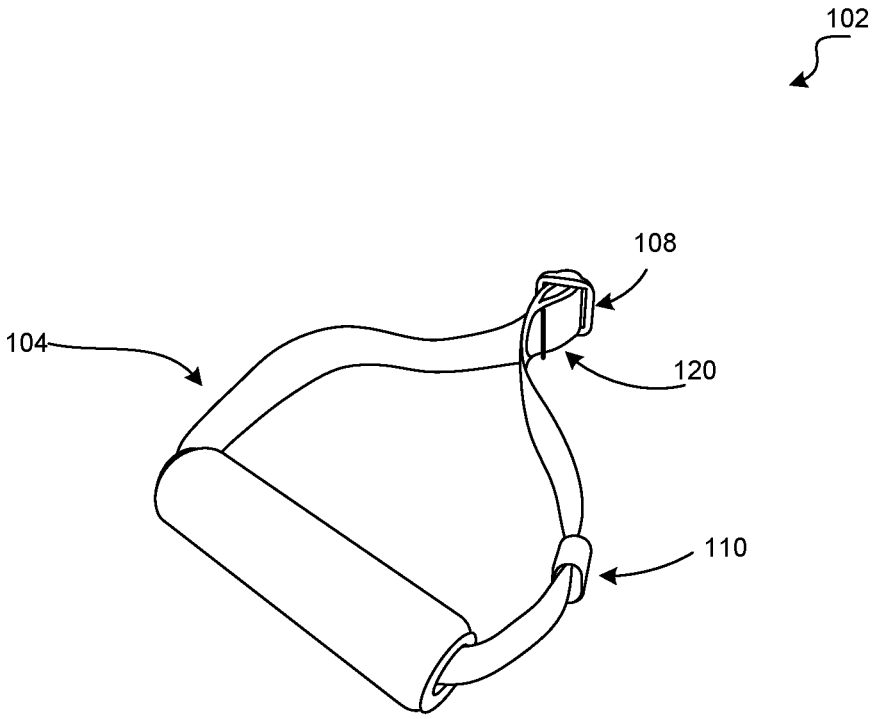
FIG. 1B illustrates one embodiment of a handle that may be used with exercise devices of the present technology.

FIG. 1B illustrates a handle 102 that can be used in the exercise device 100 illustrated in FIG. 1A. As shown, handle 102 includes webbing 104, triglide slide 108, and elastic loop 110. FIG. 1B depicts antiskid material 120 that may be affixed to webbing 104 to decrease slippage of elastic resistance member 106. In some embodiments, the sides of the handle are made of flexible material, allowing the handle to be affixed to a door jamb. Often, handles, which have adjustable capabilities, are made completely of hard plastic material and cannot be affixed inside a door jamb.

Figure 1C:
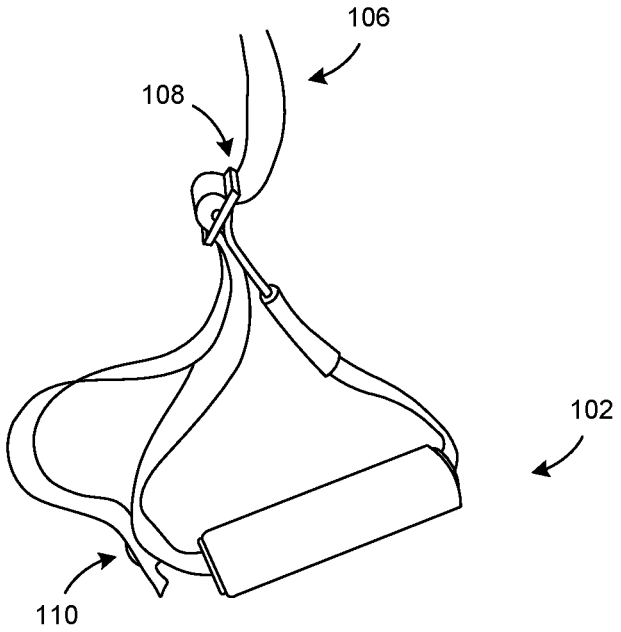
FIG. 1C illustrates one embodiment of a handle coupled to a resistance member that may be used with exercise device of the present technology.

FIG. 1C illustrates handle 102 coupled to elastic resistance member 106. As shown, triglide slide 108 is used to attach adjustable elastic resistance member 106 and elastic loop 110 is used to retain excess adjustable elastic resistance member 106.

Figure 1D:
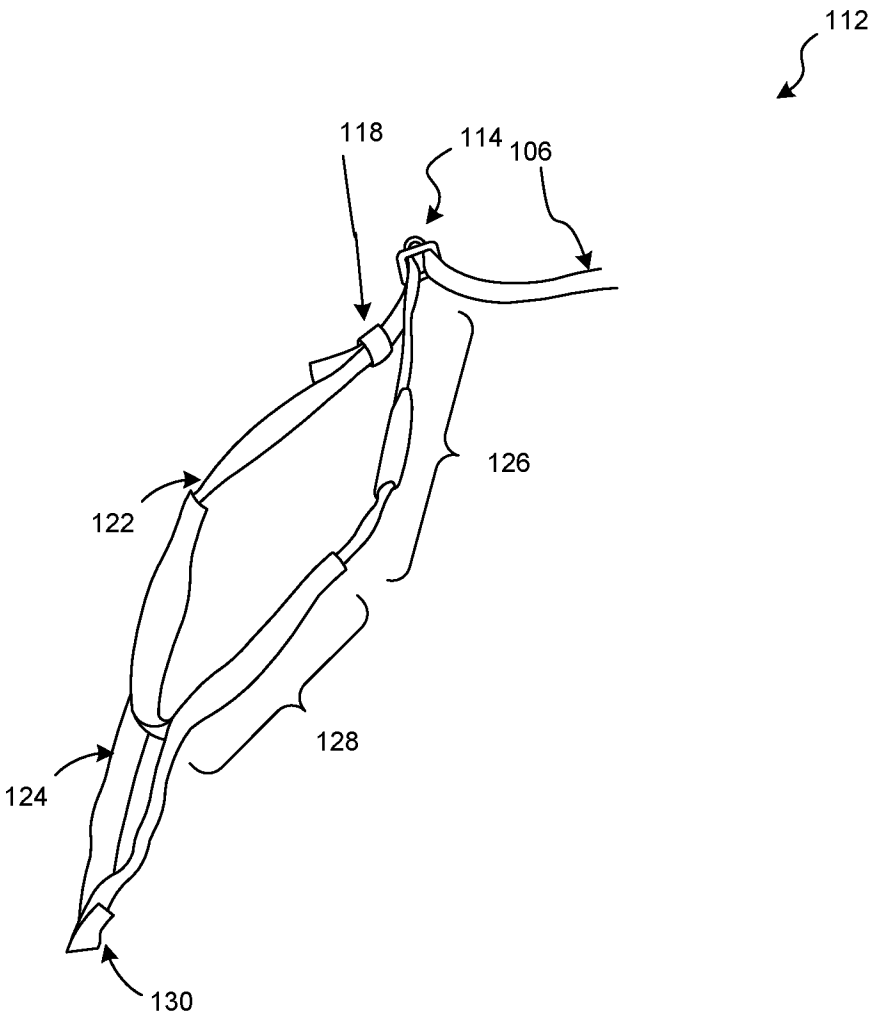
FIG. 1D illustrates one embodiment of a double loop/door attachment that may be used with exercise device of the present technology.

FIG. 1D illustrates double loop/door attachment 112. Double loop/door attachment 112 may include two loops of varying sizes to accommodate a variety of feet and appendages. The larger loop 122 can include two types of webbing with varying widths. A first portion 126 of webbing is attached to triglide slide 114. The first portion 126 of webbing may be one inch in width to allow for easy attachment with the triglide slide 114. As illustrated, elastic loop 118 restrains the tail end of elastic resistance member 106. A second portion 128 of webbing of the larger loop 122 may be one and a half inches in width to increase the surface area that comes in contact with the foot, ankle, or thigh for added comfort and ease of placement of the extremity into the loop.

The second and smaller loop 124 may be created by affixing a piece of material to larger loop 122 (e.g., by sewing smaller loop 124 onto larger loop 122). In other embodiments, larger loop 122 and smaller loop 124 are one and the same piece of material. In such embodiments, smaller loop 124 and larger loop 122 are created by attaching a portion of material to one side of the large loop to the opposing side. The smaller loop 124 allows transition between exercise positions without allowing the smaller loop to fall off of the feet of most barefooted exercisers.

Door attachment portion 130 may be created by folding over the webbing at the end of smaller loop 124 and permanently securing it in the folded-over configuration (e.g., by sewing). In some embodiments, smaller loop 124 does not include door attachment portion 130 (e.g., the exercise device shown in FIG. 5).

Figure 2A:
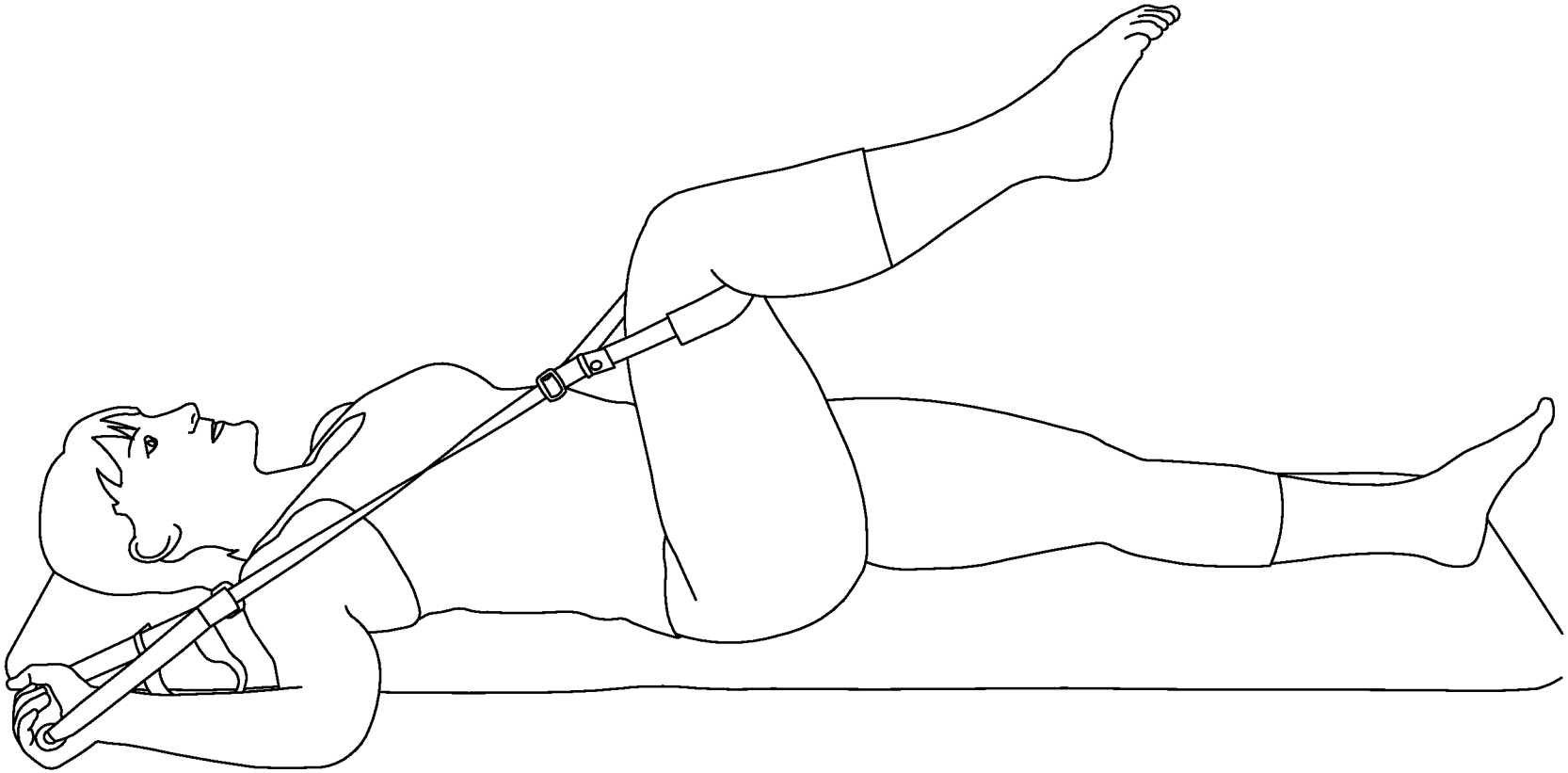
FIG. 2A illustrates one manner in which a person may use the exercise device of FIG. 1A.

FIG. 2A illustrates one manner in which a person can use the exercise device of FIG. 1A. The exercise being demonstrated in FIG. 2A is an exercise using the larger loop 122 to attach to the thigh in order to do a beginner lumbar stabilization exercise. The weight of the leg is partially supported by the tension in the resistance member 106, which decreases the weight and thus the difficulty of the exercise to the injured patient. The individual then presses downward with her thigh into the webbing of the larger loop 122, imparting proprioceptive input to the individual as she reaches her foot toward the mat.

Figure 2B:
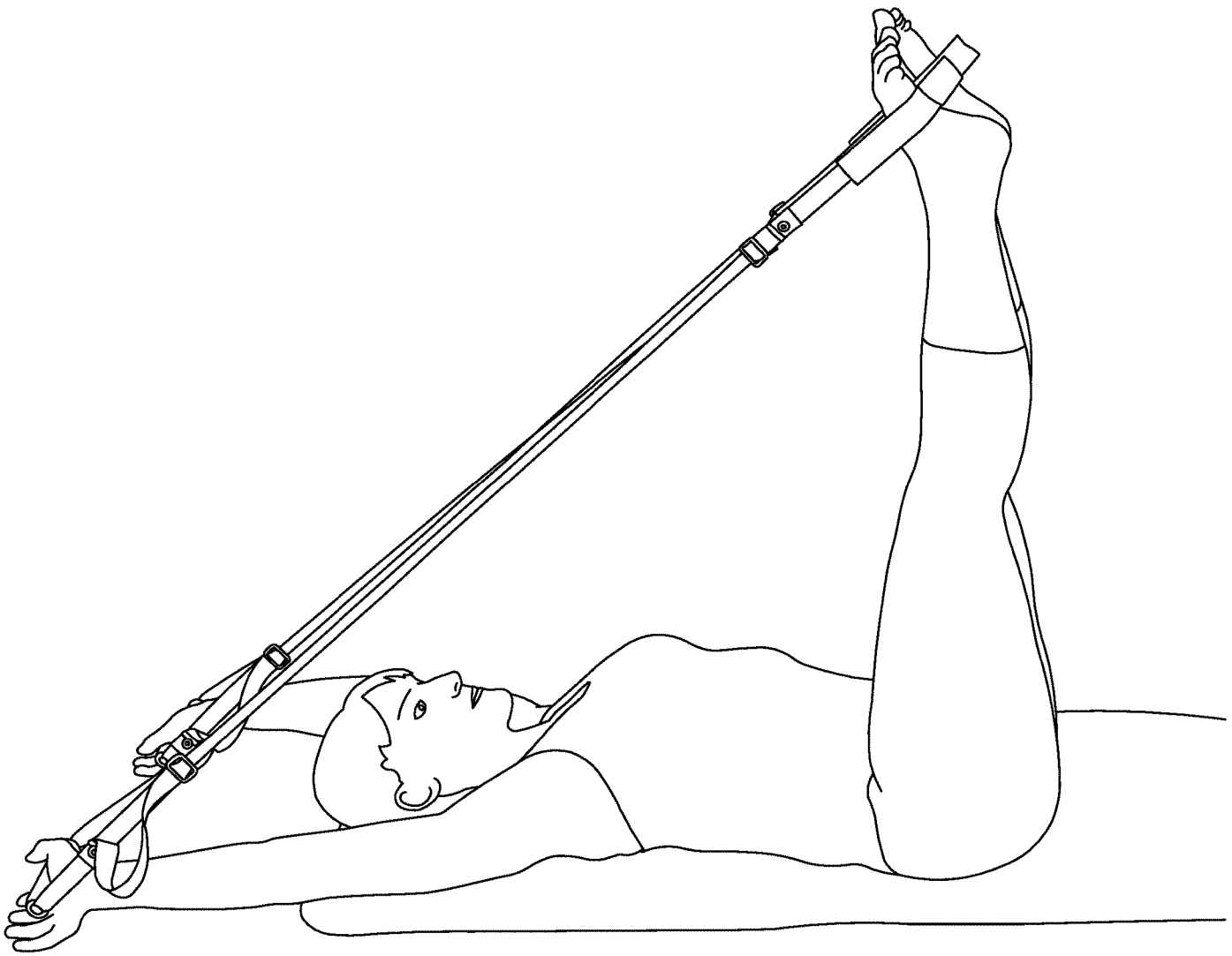
FIG. 2B illustrates one manner in which a person may use the exercise device of FIG. 1A.

FIG. 2B illustrates one manner in which a person can use the exercise device of FIG. 1A. The exercise being demonstrated in FIG. 2B is a core and leg exercise that starts with a hamstring stretch and continues by pressing the legs down toward the floor. Two exercise devices 100 may be used to involve both legs. The smaller loop ensures that the loop stays in place.

Figure 2C:
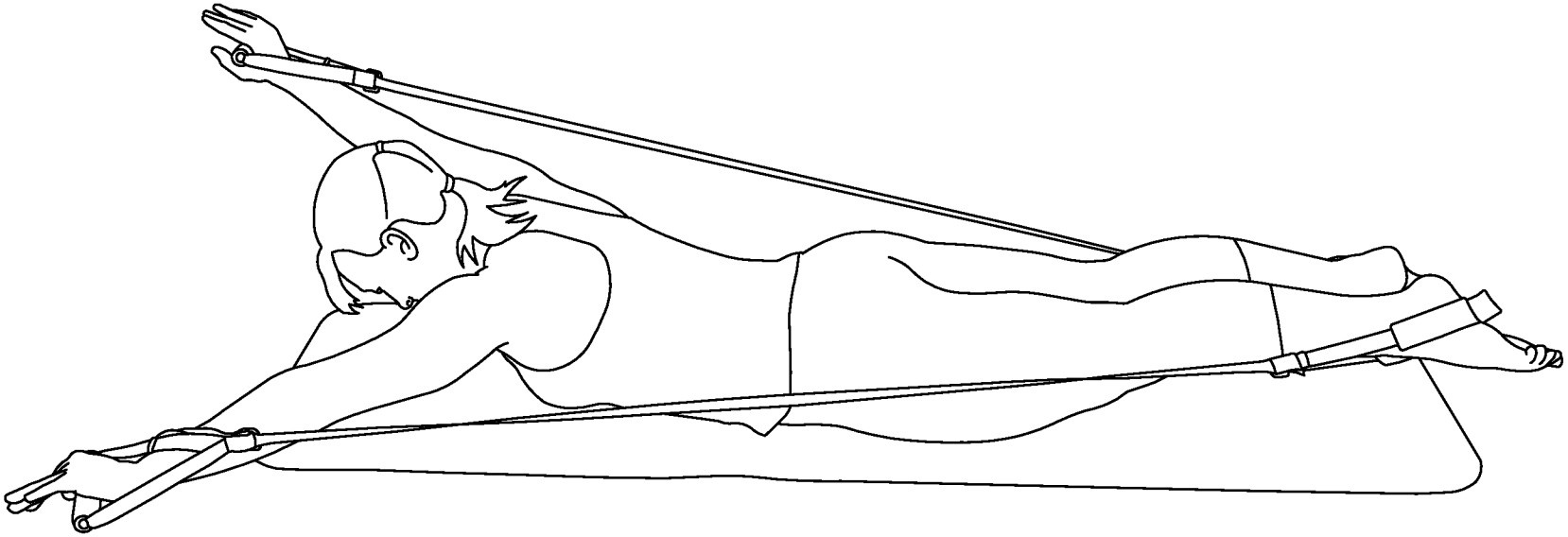
FIG. 2C illustrates one manner in which a person may use the exercise device of FIG. 1A.

FIG. 2C illustrates one manner in which a person can use the exercise device of FIG. 1A. The exercise being demonstrated in FIG. 2C is a prone exercise that works to increase the strength of the back extensors and gluteal muscles. This exercise assists the concentric phase (shortening of the muscles) of the lifting of the arm but supplies resistance to the eccentric phase (lengthening of the muscle) of the exercise. This is helpful in rehabilitation because it is generally known that increasing the strength during the eccentric phase will afford more strength gain.

Figure 2D:
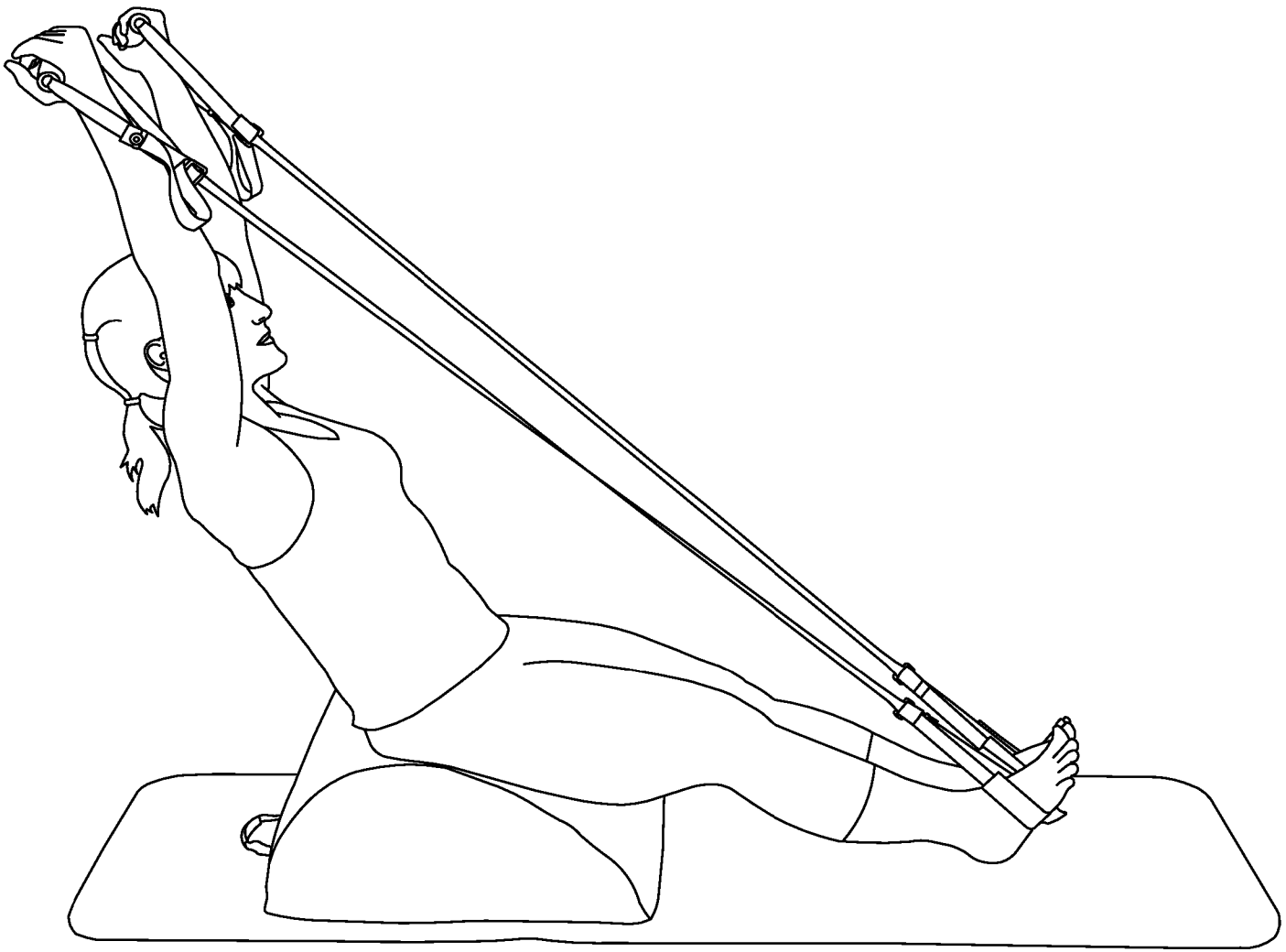
FIG. 2D illustrates one manner in which a person may use the exercise device of FIG. 1A.

FIG. 2D illustrates one manner in which a person can use the exercise device of FIG. 1A on the MINIMAX. FIG. 2D illustrates an application of the exercise device 100 being used in conjunction with another device to decrease stress for an individual with tight hamstrings. A core and arm exercise that started in the long sitting position is being performed. Using the exercise device 100 in conjunction with the MINIMAX can allow individuals with tight hamstrings to perform the exercise.

Figure 2E:
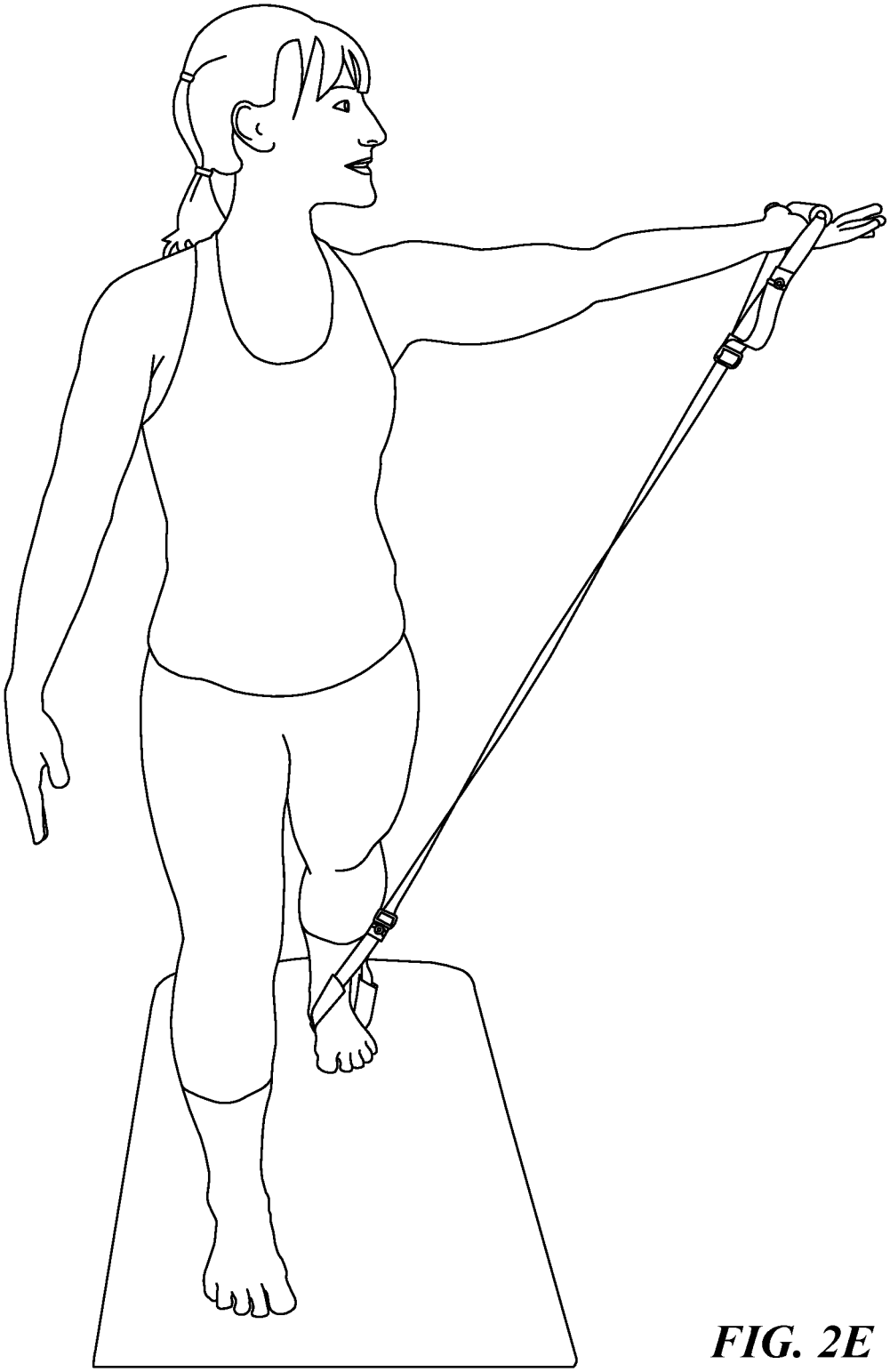
FIG. 2E illustrates one manner in which a person may use the exercise device of FIG. 1A.

FIG. 2E illustrates one manner in which a person can use the exercise device of FIG. 1A. The exercise being demonstrated in FIG. 2E is a standing exercise that challenges the leg, arms, obliques, and balance.

Figure 2F:
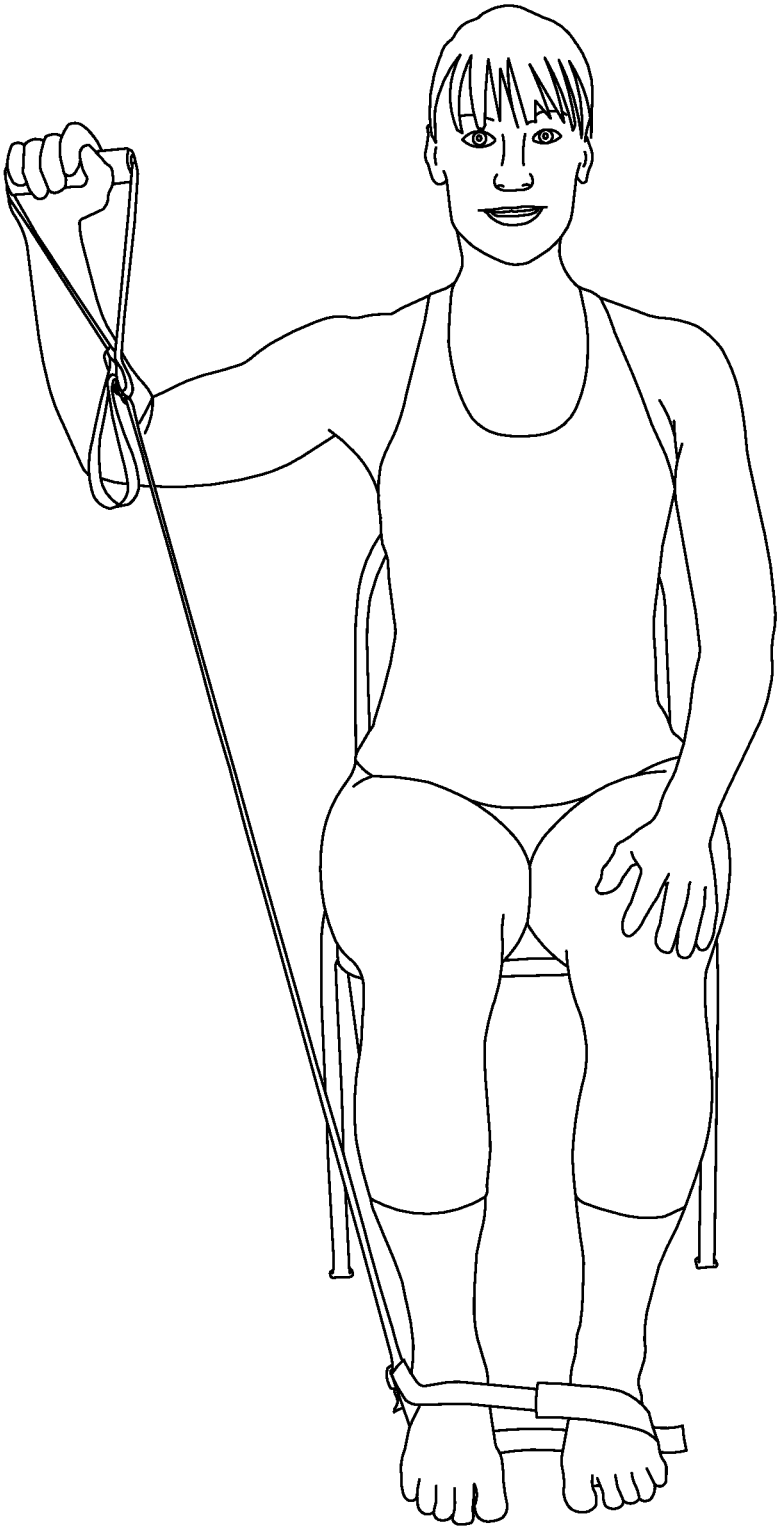
FIG. 2F illustrates one manner in which a person may use the exercise device of FIG. 1A.

FIG. 2F illustrates one manner in which a person can use the exercise device of FIG. 1A on a chair. FIG. 2F demonstrates how the larger loop 122 can be used while exercising the rotator cuff while seated on a chair.

FIGS. 3A-3H demonstrate manners in which the exercise device 100 can be used by attaching the exercise device to a door at varying heights. Because of the flexible nature of the material of the double loop and the handle, either the handle 102 end or the or the double loop/door attachment 112 end may be affixed to a door jamb. The exercise device 100 may be secured to the door by placing the handle 102 or the double loop/door attachment 112 through an open door at the top, side, or bottom of the door and closing the door such that the handle 102 or double loop/door attachment 112 is on the opposite side of the door than the person and the rest of the exercise device 100. For example, the handle may serve as the "stopper" for the exercise device from sliding out from under the door or from the side or top of the door jamb. The smaller loop 124 may be placed into the door jamb and the folded over webbing portion 130 of the smaller loop may serve as the "stopper" to keep the exercise device from sliding out of the door jamb.

Figure 3A:
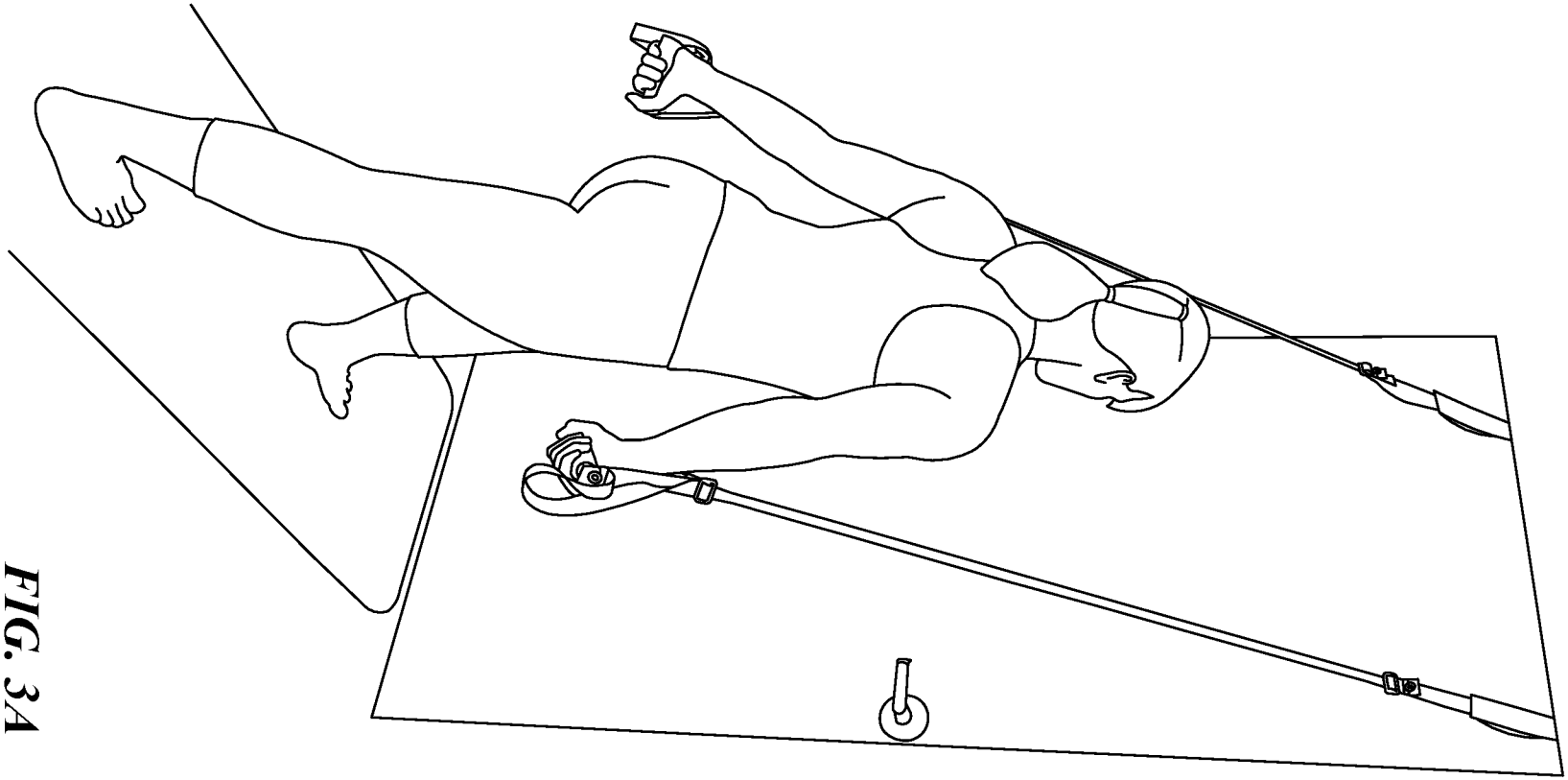
FIG. 3A illustrates one manner in which a person may use the exercise device of FIG. 1A.

FIG. 3A illustrates a person performing triceps extension exercise in a lunge position with the double loop/door attachment 112 of each exercise device of FIG. 1A attached to the door at the top of the door.

Figure 3B:
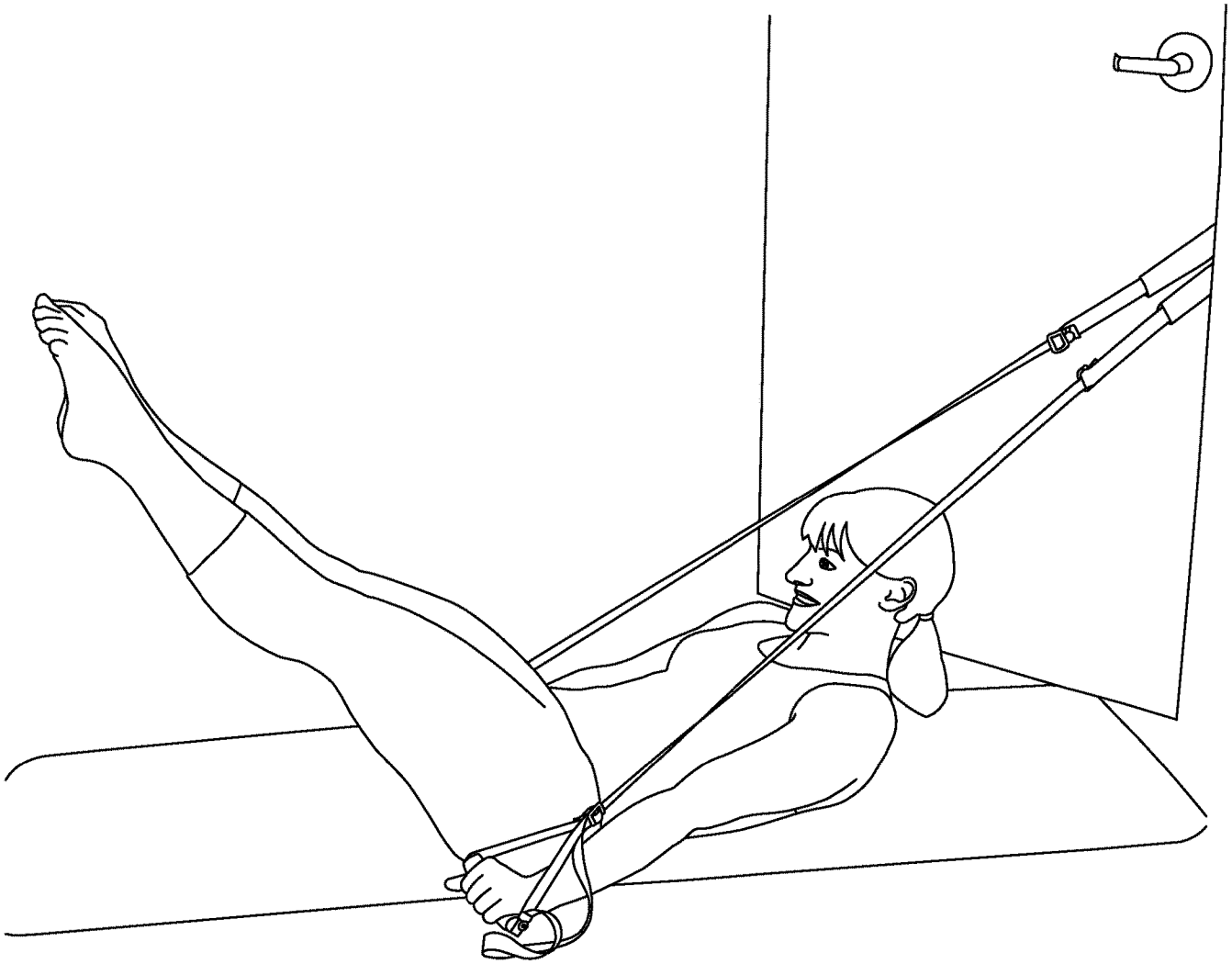
FIG. 3B illustrates one manner in which a person may use the exercise device of FIG. 1A.

FIG. 3B illustrates a person performing the hundreds (a Pilates exercise) using two of the exercise devices of FIG. 1A, where each double loop/door attachment 112 is attached to the door near the height of the door handle.

Figure 3C:
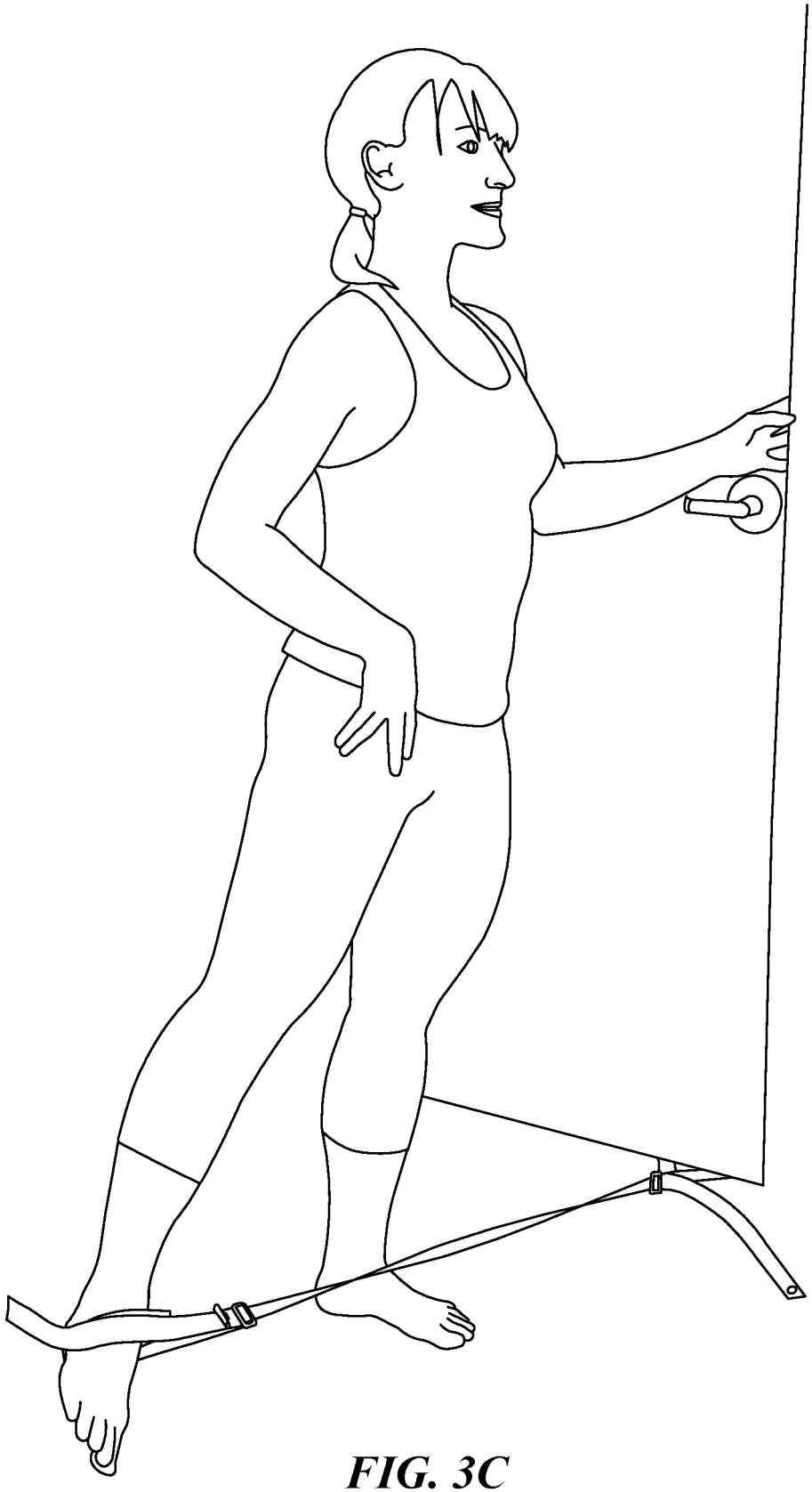
FIG. 3C illustrates one manner in which a person may use the exercise device of FIG. 1A.

FIG. 3C illustrates a person performing a standing hip abduction exercise with the handle 102 end attached to the door jamb.

Figure 3D:
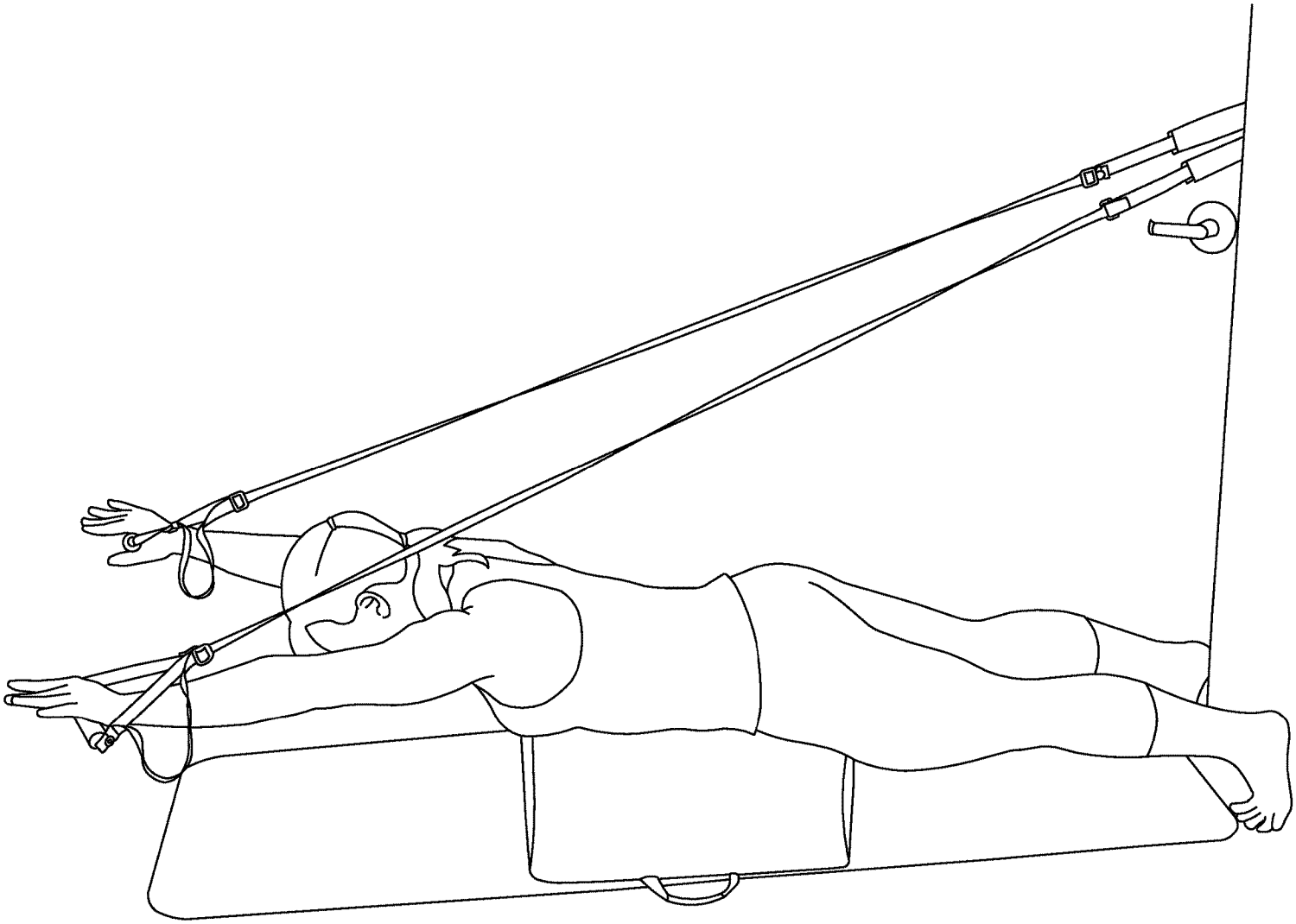
FIG. 3D illustrates one manner in which a person may use the exercise device of FIG. 1A.

FIG. 3D illustrates a person performing a back and arms strengthening exercise performed using two of the exercise devices of FIG. 1A in conjunction with a separate device, which is appropriate for individuals with lumbar spine stenosis.

Figure 3E:
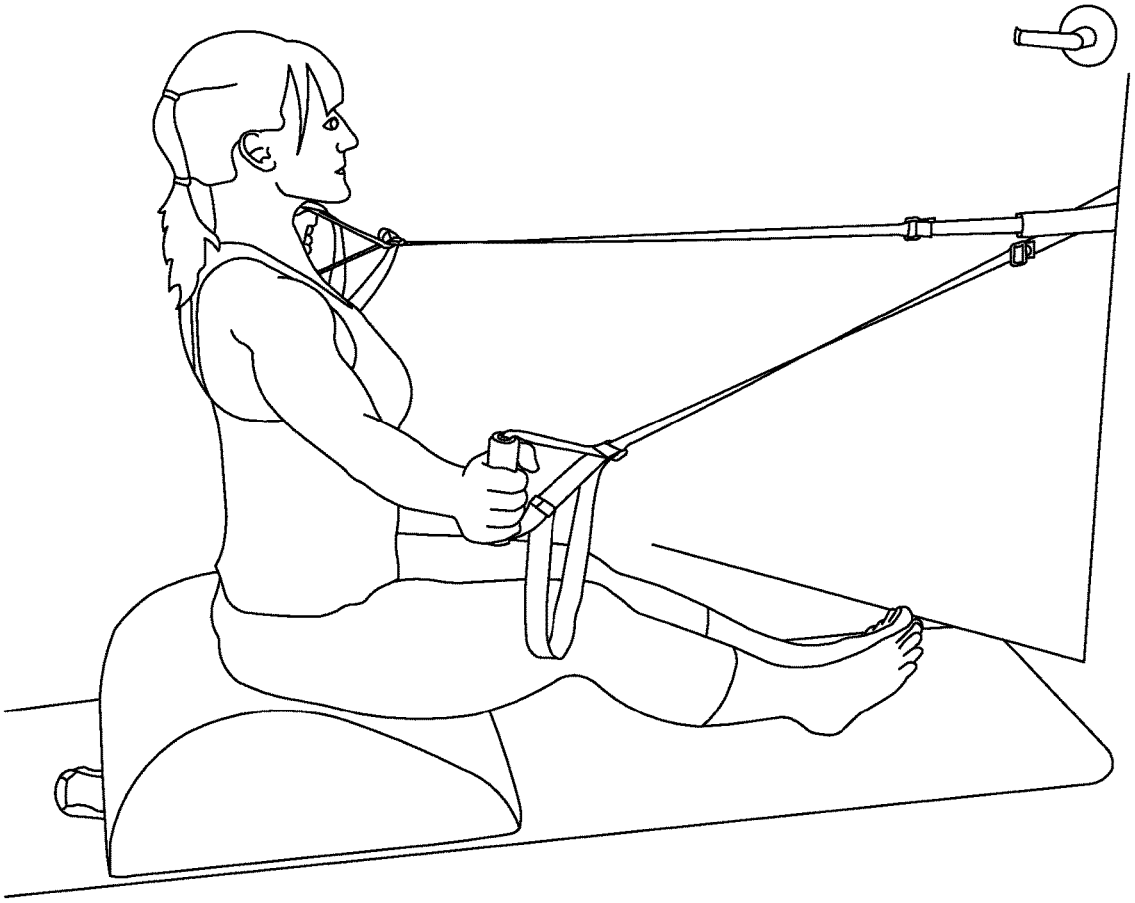
FIG. 3E illustrates one manner in which a person may use the exercise device of FIG. 1A.

FIG. 3E illustrates a person performing a straight arm row using two of the exercise devices of FIG. 1A in conjunction with a separate device while in the long sitting position. This modification can be beneficial for individuals with tight hamstrings where sitting with legs outstretched on the floor would strain the hamstrings and therefore the lower back.

Figure 3F:
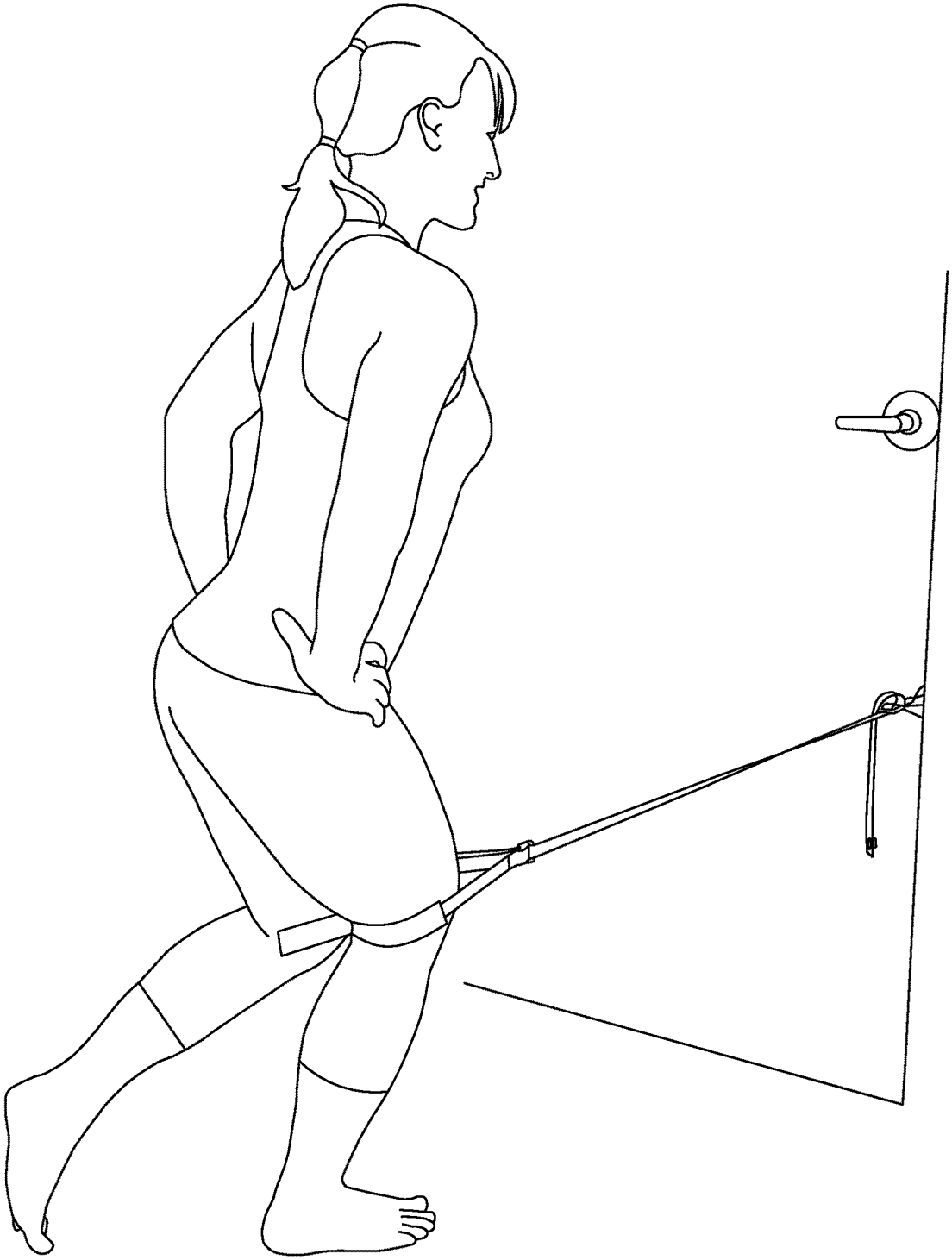
FIG. 3F illustrates one manner in which a person may use the exercise device of FIG. 1A.

FIG. 3F illustrates a person performing a terminal knee extension using the exercise device of FIG. 1A. The terminal knee extension is an early leg strengthening exercise in physical therapy. The handle 102 end of the device is attached to the door, and the larger loop 122 will be placed around the lower thigh to supply the patient with proprioceptive input as she presses her knee into extension, enabling her to improve movement awareness while standing. The exercise device 100 in this formation also provides resistance to strengthen the user's thigh and gluteus muscles.

Figure 3G:
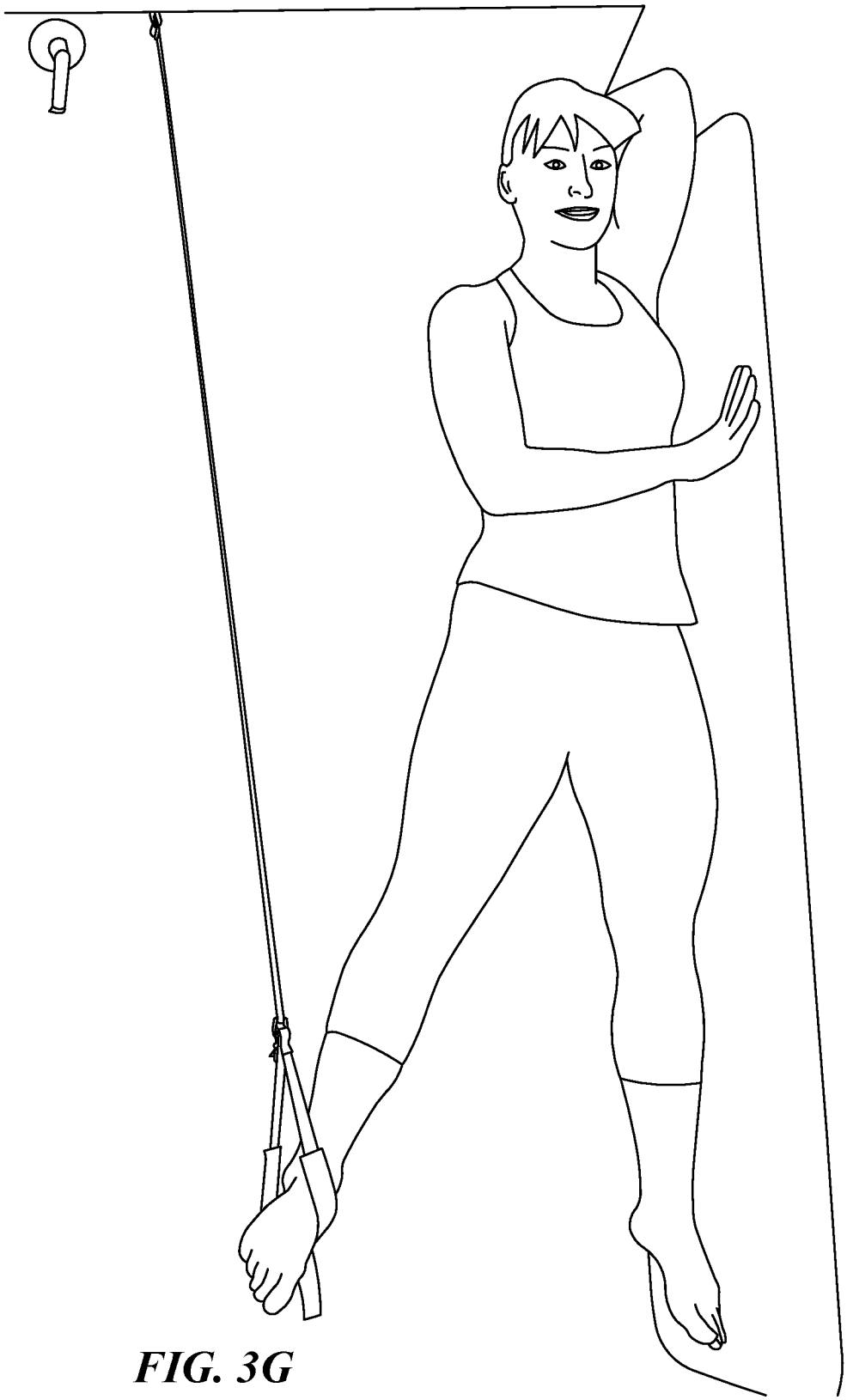
FIG. 3G illustrates one manner in which a person may use the exercise device of FIG. 1A.

FIG. 3G illustrates a person performing leg and abdominal exercises using the exercise device of FIG. 1A. The resistance in the elastic resistance member 106 is adjusted so that there is resistance when the leg is reaching straight. Then, the person lifts the leg up and down. This exercise directly challenges hip strength but also indirectly works on core strength because the person is required to balance on the side of her body.

Figure 3H:
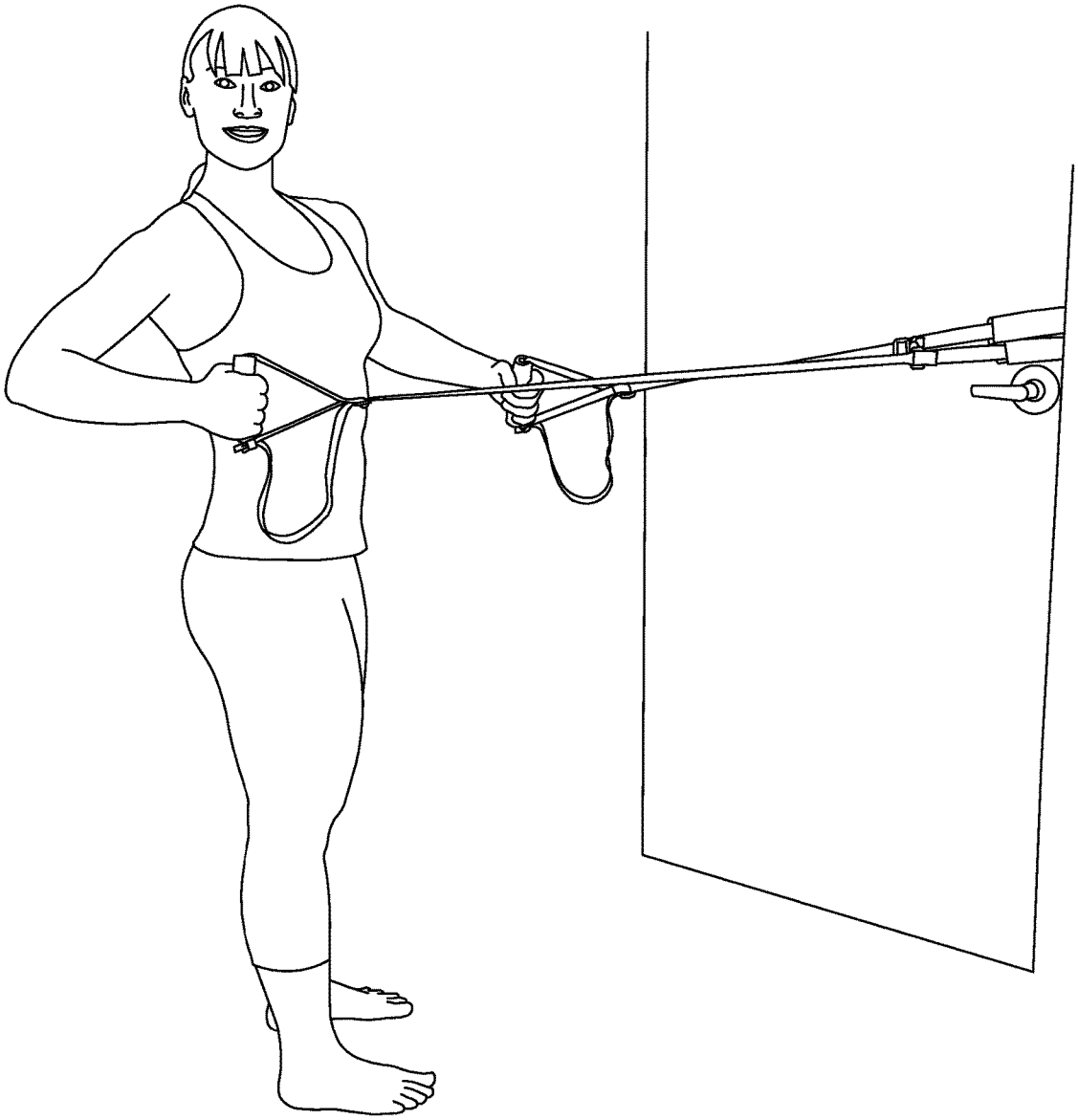
FIG. 3H illustrates one manner in which a person may use the exercise device of FIG. 1A.

FIG. 3H illustrates a person performing a standing row with rotation of the spine using two of the exercise devices of FIG. 1A. To perform the exercise, the double foot loop/door attachments 112 are secured in the door jamb (on top of one another) and the bent arms are drawn behind the body as the torso is rotated to the same side, alternating arms.

Figure 4A:
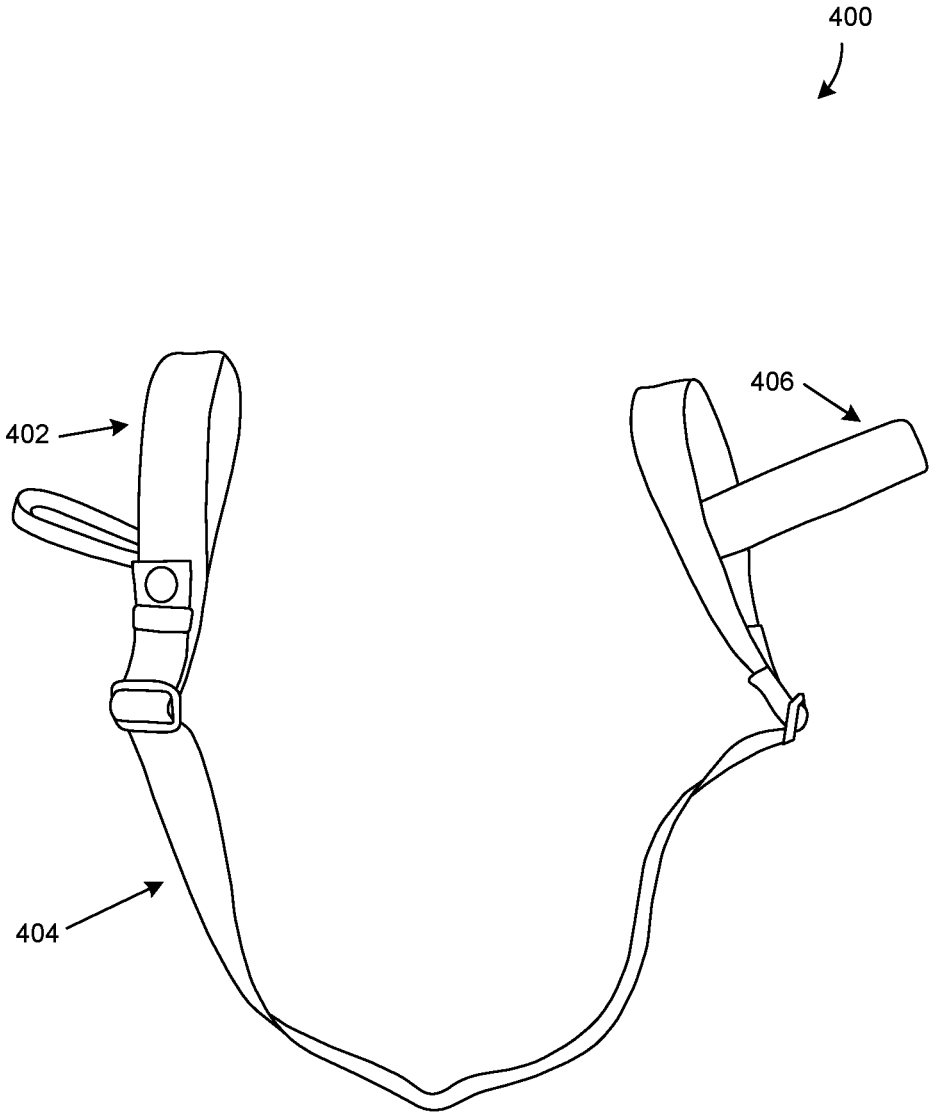
FIG. 4A illustrates one embodiment of an exercise device according to the present technology with a hand stirrup system and a foot stirrup system.

FIG. 4A illustrates exercise device 400 with a hand stirrup system 402 on one end of elastic resistance member 404 and a foot stirrup system 406 on the opposing end of the adjustable resistance member 406.

Figure 4B:
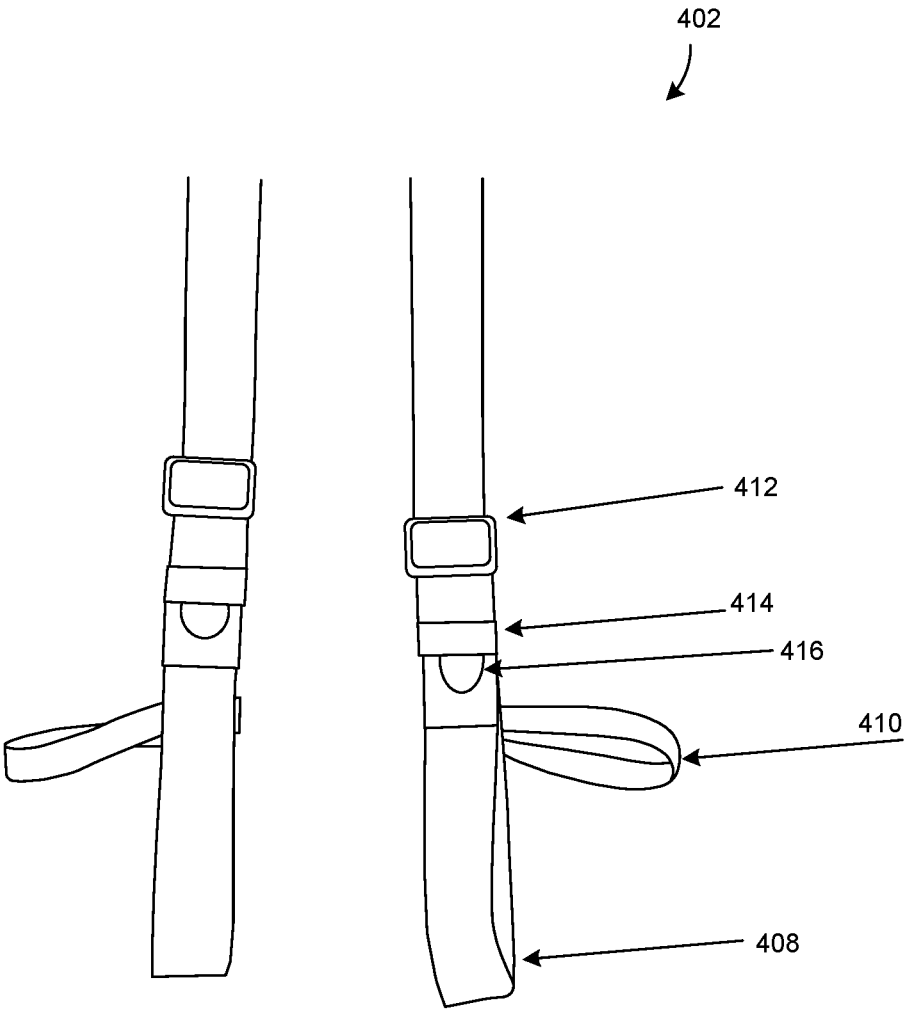
FIG. 4B illustrates a hand stirrup system that may be used with exercise devices according to the present technology.

FIG. 4B illustrates two hand stirrup systems 402 of exercise device 400. A first portion 408 of the hand stirrup system 402 wraps diagonally across the palm. The first portion 408 may be made of an inelastic material such as webbing made of cotton or polypropylene. A second portion 410 wraps around the wrist. The second portion 410 may be made of elastic webbing, which makes inserting the hand into the stirrup system easier. The hand stirrup system may also include triglide slide 412, elastic member 414, and rivet 416.

Figure 4C:
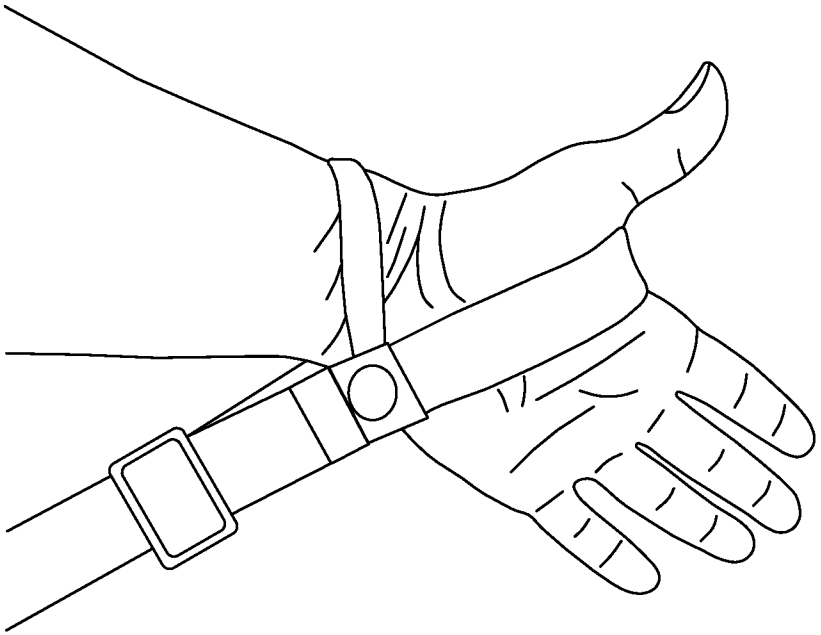
FIG. 4C illustrates a hand stirrup system that may be used with exercise devices according to the present technology.

FIG. 4C illustrates the hand stirrup system 402 with a hand inserted between the two portions of the hand stirrup system.

Figure 4D:
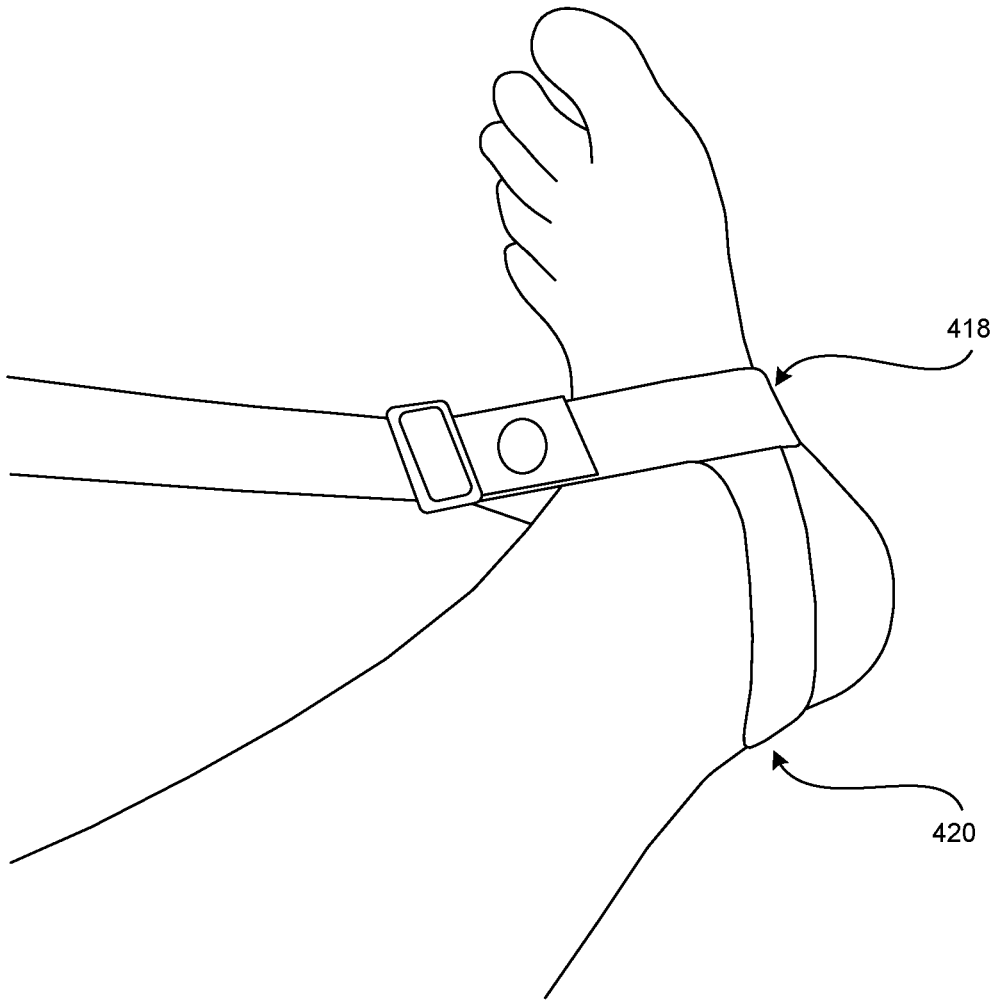
FIG. 4D illustrates a foot stirrup system that may be used with exercise devices according to the present technology.

FIG. 4D illustrates the foot stirrup system 406 with a foot inserted between the two portions of the foot stirrup system. A first portion 418 wraps around the arch of the foot. The first portion 418 may be made of an inelastic material such as webbing made of cotton or polypropylene. A second portion 420 wraps around the lower portion of the calf. The second portion 420 may be made of elastic webbing to make inserting the foot easier. In some embodiments, exercise device 400 includes only a foot loop and does not include the elastic webbing that goes around the lower portion of the calf.

Figure 5:
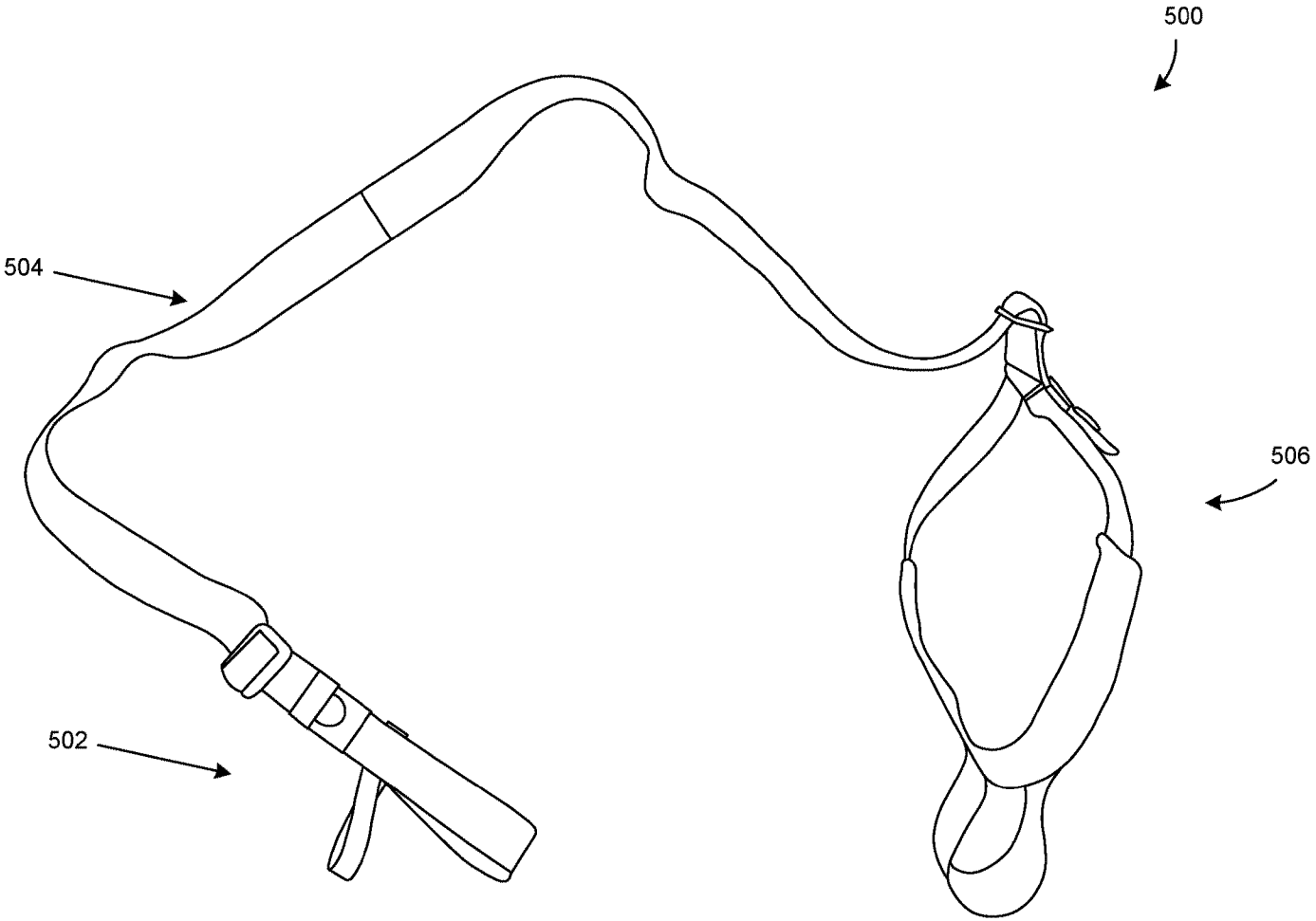
FIG. 5 illustrates one embodiment of an exercise device according the present technology with a hand stirrup system and a double loop/door attachment.

FIG. 5 illustrates an exercise device 500 with hand stirrup system 502, adjustable resistance member 504, and a double loop 506.

Figure 6A:
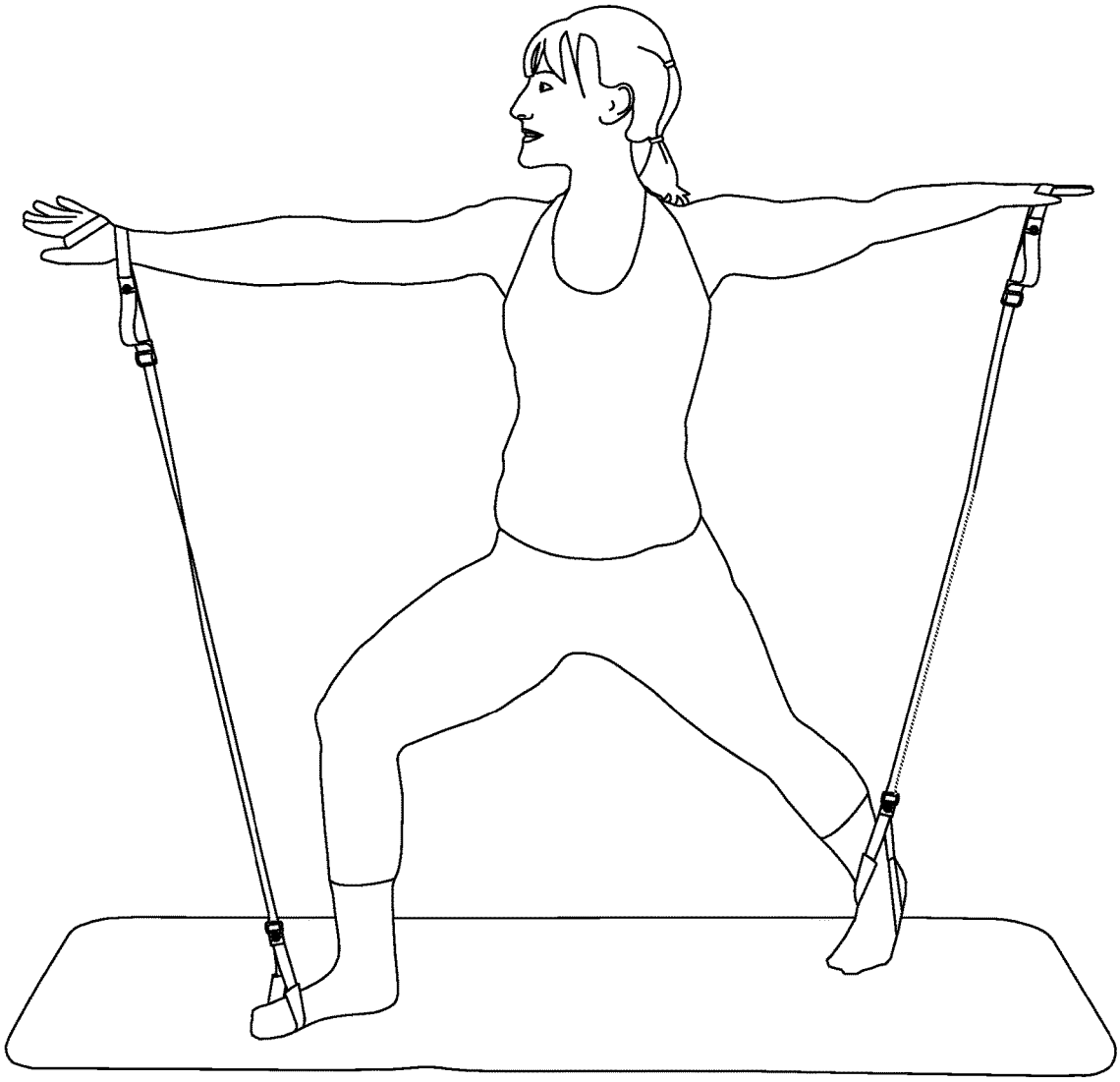
FIG. 6A illustrates one manner in which a person can use the exercise device of FIG. 7.
Figure 6B:
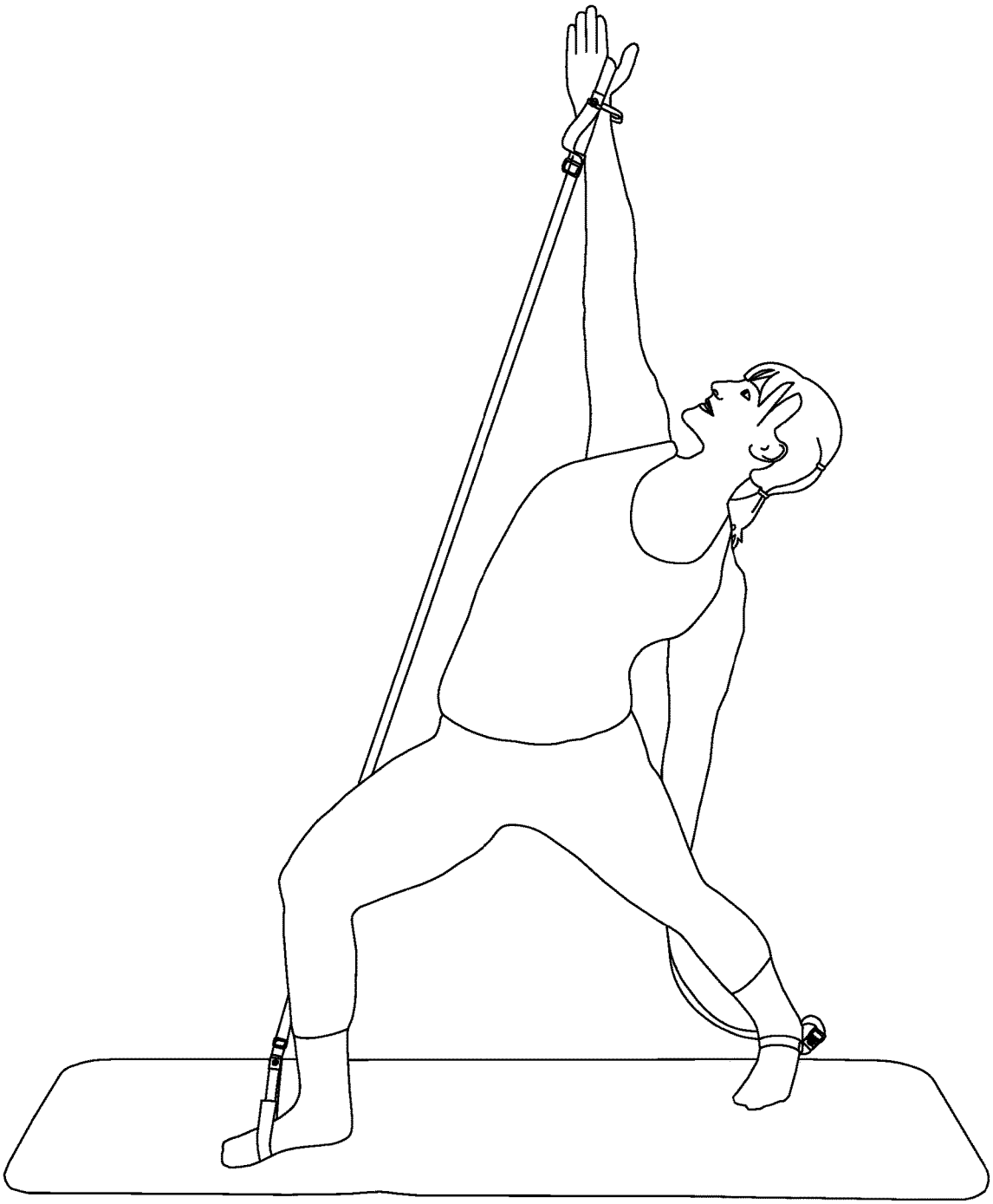
FIG. 6B illustrates one manner in which a person can use the exercise device of FIG. 7.

FIGS. 6A-6B illustrate a person demonstrating yoga exercises using the exercise device shown in FIG. 5.

Figure 6C:
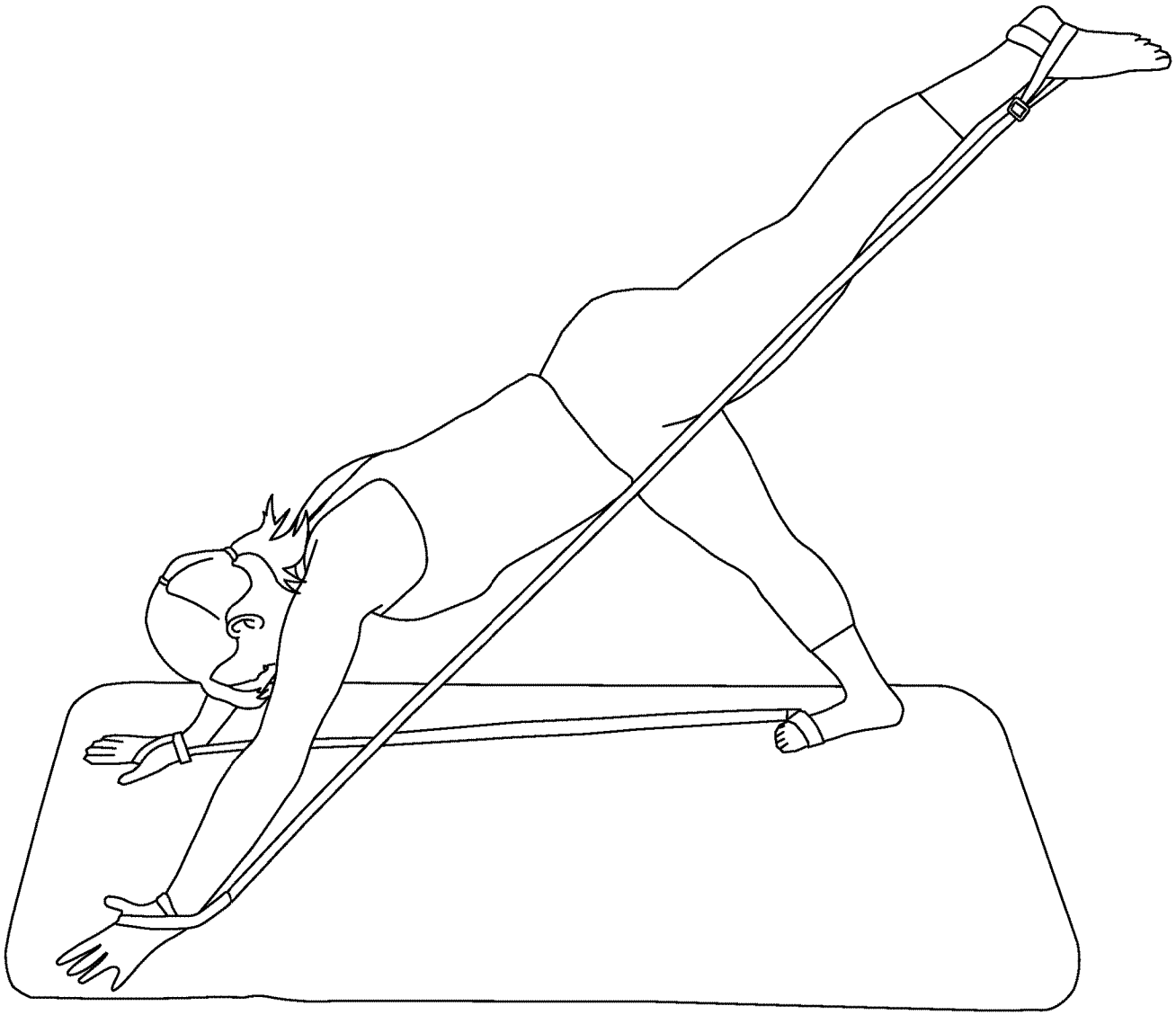
FIG. 6C illustrates one manner in which a person can use the exercise device of FIG. 4A.

FIG. 6C illustrates a person demonstrating a yoga exercise using the exercise device shown in FIG. 4A.

Remarks

The above description and drawings are illustrative and are not to be construed as limiting. Numerous specific details are described to provide a thorough understanding of the disclosure. However, in some instances, well-known details are not described in order to avoid obscuring the description. Further, various modifications may be made without deviating from the scope of the disclosure. Accordingly, the disclosure is not limited except as by the appended claims.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. It will be appreciated that the same thing can be said in more than one way. Consequently, alternative language and synonyms may be used for any one or more of the terms discussed herein, and any special significance is not to be placed upon whether or not a term is elaborated or discussed herein. Synonyms for some terms are provided. A recital of one or more synonyms does not exclude the use of other synonyms. The use of examples anywhere in this specification, including examples of any term discussed herein, is illustrative only and is not intended to further limit the scope and meaning of the disclosure or of any exemplified term. Likewise, the disclosure is not limited to various embodiments given in this specification. Unless otherwise defined, all technical and scientific terms used herein have the same meaning as commonly understood by one of ordinary skill in the art to which this disclosure pertains. In the case of conflict, the present document, including definitions, will control.

What is claimed is:

1. An exercise system comprising:

an elongated elastic resistance member having a first end portion and an opposite second end portion;

a handle, comprised of a flexible, inelastic material, operatively coupled to the first end portion of the elastic resistance member, such that the handle may be selectively secured in one of various positions along a length of the elastic resistance member; and an attachment coupled to the second end portion of the elastic resistance member, such that the attachment may be selectively secured in one of various positions along the length of the elastic resistance member, wherein the attachment includes a first loop and a second loop that are each formed from a flexible, inelastic material, wherein the second loop is formed by attaching the flexible, inelastic material to opposing sides on an external surface of the first loop such that the first loop and the second loop are substantially co-planar, wherein the second loop includes a door attachment that is continuous with the flexible inelastic material, wherein the door attachment comprises folded-over flexible, inelastic material located at a center of an arc of the second loop, wherein adjustment of a position of either or both of the handle and attachment along the length of the elastic resistance member, toward or away from one another, adjusts the length of the elastic resistance member, wherein substantially an entirety of the second loop is positioned further from the handle than the first loop.

2. The exercise system of claim 1, wherein the handle includes an elongated, rigid gripping member and opposite, flexible sides that extend from the gripping member and operatively couple with the elastic resistance member.

3. The exercise system of claim 1, wherein the handle is operatively coupled with the elastic resistance member using a first triglide slide, wherein a position of the handle along the length of the elastic resistance member is adjustable by passing the first end portion of the elastic resistance member through the first triglide slide; wherein an anti-skid material is attached to the handle, adjacent the triglide slide to prevent the elastic resistance member from sliding through the first triglide slide.

4. The exercise system of claim 3, wherein the attachment is operatively coupled with the elastic resistance member using a second triglide slide, wherein a position of the attachment along the length of the elastic resistance member is adjustable by passing the second end of the elastic resistance member through the second triglide slide.

5. The exercise system of claim 1, further comprising:

a first elastic loop attached to a side of the handle and shaped to secure the first end portion of the elastic resistance member within the first elastic loop; and a second elastic loop attached to a side of the attachment and shaped to secure the second end portion of the elastic resistance member within the second elastic loop.

6. The exercise system of claim 3, further comprising a fastener affixed on an end portion of the first end portion of the elastic resistance member to prevent the first end portion of the elastic resistance member from passing through the first triglide slide.

7. The exercise system of claim 1, wherein a second portion of the first loop has a surface area that is wider than a surface area of a first portion of the first loop.

8. The exercise system of claim 1, wherein the first loop is bigger than the second loop.

* * * * *